US010608315B2

(12) United States Patent
Anolik et al.

(10) Patent No.: US 10,608,315 B2
(45) Date of Patent: Mar. 31, 2020

(54) REMOTE UNIT ASSEMBLIES FOR DISTRIBUTED COMMUNICATION SYSTEMS (DCSS) AND RELATED ACCESSING METHODS

(71) Applicant: Corning Optical Communications LLC, Hickory, NC (US)

(72) Inventors: Rami Anolik, Beit Arie (IL); Ami Hazani, Ra'anana (IL); Eduardo Woginiak, Kfar Saba (IL)

(73) Assignee: Corning Optical Communications LLC, Charlotte, NC (US)

( * ) Notice: Subject to any disclaimer, the term of this patent is extended or adjusted under 35 U.S.C. 154(b) by 79 days.

(21) Appl. No.: 15/867,236

(22) Filed: Jan. 10, 2018

(65) Prior Publication Data

US 2018/0131071 A1 May 10, 2018

Related U.S. Application Data

(63) Continuation of application No. PCT/IL2016/050834, filed on Jul. 31, 2016.
(Continued)

(51) Int. Cl.
*H01Q 1/08* (2006.01)
*H01Q 1/12* (2006.01)
(Continued)

(52) U.S. Cl.
CPC ..... *H01Q 1/1214* (2013.01); *H01Q 1/007* (2013.01); *H01Q 1/084* (2013.01); *H01Q 1/1207* (2013.01); *H01Q 1/02* (2013.01); *H01Q 1/1221* (2013.01)

(58) Field of Classification Search
CPC ..... H01Q 1/00; H01Q 1/007; H01Q 1/02; H01Q 1/08; H01Q 1/084; H01Q 1/12;
(Continued)

(56) References Cited

U.S. PATENT DOCUMENTS 5,261,645 A * 11/1993 Huffman ..... E04B 9/003 248/277.1
5,407,261 A * 4/1995 Mercer ..... A47B 46/005 312/245

(Continued)

FOREIGN PATENT DOCUMENTS

WO 1997011506 A1 3/1997

OTHER PUBLICATIONS

International Search Report and Written Opinion of the International Searching Authority; PCT/IL2016/050834 dated October 31, 2016; 12 Pages; European Patent Office.

(Continued)

*Primary Examiner* — Tho G Phan
(74) *Attorney, Agent, or Firm* — C. Keith Montgomery

(57) ABSTRACT

Systems and related accessing methods for remote unit assemblies for distributed communications systems are provided. A support member (e.g., a support plate) is arranged to be mounted in a drop ceiling grid, and a pivotally mounted pivot arm arranged above the support plate is configured to receive at least one electronic component. The pivot arm allows the electronic component to pivot downwardly from a ceiling structure for easier access. A slow release mechanism is configured to reduce a rate of pivotal motion of the pivot arm. A retention mechanism selectively retains the electronic component in a substantially horizontal position proximate to the support plate. A vented antenna cover below the support plate is pivotally mounted to the electronic component with at least one pivotal link, and may include an integrated antenna.

20 Claims, 26 Drawing Sheets

Related U.S. Application Data

(60) Provisional application No. 62/199,545, filed on Jul. 31, 2015.

(51) Int. Cl.
*H01Q 1/00* (2006.01)
*H01Q 1/02* (2006.01)

(58) Field of Classification Search
CPC .. H01Q 1/1207; H01Q 1/1214; H01Q 1/1221; H01Q 1/36; H01Q 1/50
See application file for complete search history.

(56) References Cited

U.S. PATENT DOCUMENTS 5,562,392 A * 10/1996 Raben ..... B66F 9/18 414/608
5,911,661 A * 6/1999 Murray ..... E04B 9/003 174/491
6,121,737 A * 9/2000 Guenther ..... E04B 9/006 248/320
6,321,259 B1 11/2001 Ouellette et al.
8,083,300 B2 12/2011 Macall
8,235,349 B1 8/2012 Conklin et al.
8,385,850 B1 2/2013 Thompson et al.
9,661,781 B2 5/2017 Anolik et al.
2002/0133420 A1 9/2002 McCoy et al.
2004/0127196 A1 7/2004 Dabbish et al.
2007/0107067 A1 5/2007 Fountain
2007/0164917 A1 7/2007 Takisawa et al.
2008/0021838 A1 1/2008 Wardaschka et al.
2009/0050762 A1* 2/2009 Mallela ..... F16M 11/10 248/278.1
2010/0134964 A1 6/2010 Smith et al.
2012/0293391 A1 11/2012 Simmons et al.

OTHER PUBLICATIONS

Oberon Inc. "Suspended Ceiling Access Point Enclosures"; 6 Pages; http://www.oberonwireless.com/plenum-rated-access-point-enclosures.php.

* cited by examiner 322
338
341
340
343
345
334
315
324
325

322
338
335
315
334
338
340
324
334
335
315
325

334
335
315

REMOTE UNIT ASSEMBLIES FOR DISTRIBUTED COMMUNICATION SYSTEMS (DCSS) AND RELATED ACCESSING METHODS

CROSS-REFERENCE TO RELATED APPLICATIONS

This is a continuation of International Application No. PCT/IL2016/050834, filed Jul. 31, 2016, which claims the benefit of priority under 35 U.S.C. § 119 of U.S. Provisional Patent Application No. 62/199,545, filed Jul. 31, 2015, the contents of which are relied upon and incorporated herein by reference in their entireties.

BACKGROUND

The disclosure relates generally to distributed communication systems (DCSs), such as distributed antenna systems (DASs) as an example, and more particularly to remote unit assemblies and related accessing methods for such systems.

Distributed antenna systems or distributed communication systems provide wireless communications and other services within a building, stadium, and other infrastructures. Such systems permit wireless customers to use wireless communication services for demanding digital data applications (e.g., streaming video signals) in areas that are poorly serviced by conventional cellular networks, such as inside certain buildings or other areas where cellular coverage is poor. One approach to deploying a DAS involves the use of radio frequency (RF) antenna coverage areas, also referred to as "antenna coverage areas." The antenna coverage areas are provided by remote antenna units (RAUs), or more generally "remote units." Remote units provide antenna coverage areas typically having radii from a few meters up to twenty (20) meters. If the antenna coverage areas each cover a small area, there are typically only a few users (clients) per antenna coverage area. This minimizes the amount of RF bandwidth shared among the wireless system users.

FIG. 1 illustrates distribution of communications services to remote coverage areas 100(1)-100(N) of a DAS 102, wherein 'N' is the number of remote coverage areas. These communications services can include cellular services, wireless services, such as RF identification (RFID) tracking, Wireless Fidelity (Wi-Fi), local area network (LAN), and wireless LAN (WLAN), wireless solutions (Bluetooth, Wi-Fi Global Positioning System [GPS] signal-based, and others) for location-based services, and combinations thereof, as examples. The remote coverage areas 100(1)-100(N) are created by and centered on RAUs 104(1)-104(N) connected to a centralized equipment 106 (e.g., a head-end controller, a head-end unit, or a central unit). The centralized equipment 106 may be communicatively coupled to a source transceiver 108, such as for example, a base transceiver station (BTS) or a baseband unit (BBU). In this regard, the centralized equipment 106 receives downlink communications signals 110D from the source transceiver 108 to be distributed to the RAUs 104(1)-104(N). The downlink communications signals 110D can include data communications signals and/or communication signaling signals, as examples. The RAUs 104(1)-104(N) are configured to receive the downlink communications signals 110D from the centralized equipment 106 over a communications medium 112 to be distributed to the respective remote coverage areas 100(1)-100(N) of the RAUs 104(1)-104(N). In a non-limiting example, the communications medium 112 may be a wired communications medium, a wireless communications medium, or an optical fiber-based communications medium. Each of the RAUs 104(1)-104(N) may include an RF transmitter/receiver (not shown) and a respective antenna 114(1)-114(N) operably connected to the RF transmitter/receiver to wirelessly distribute the communications services to user equipment (UE) 116 within the respective remote coverage areas 100(1)-100(N). The RAUs 104(1)-104(N) are also configured to receive uplink communications signals 110U from the UEs 116 in the respective remote coverage areas 100(1)-100(N) to be distributed to the source transceiver 108.

Remote units are commonly mounted in a ceiling in such a way that radio frequency signals from the remote unit's antenna are not obstructed by the ceiling. If active remote antenna units are part of the DAS, the DAS designer should also ensure that the mounting structure allows for sufficient dissipation of the heat generated by remote unit's electronics. It is also desirable that the remote unit mounting structure, as well as the remote unit itself, be as unobtrusive and aesthetically pleasing as possible.

In some wireless systems, such as DASs, remote units are mounted in multiple locations around a building, including ceiling mounts. Secure mounting in a ceiling should be provided due to the weight of a typical remote unit, to guard against the possibility of a remote unit falling from the ceiling. Ensuring physical safety of service personnel and users proximate to a remote unit is desirable. One approach to secure a remote unit is to mount the remote unit to a rigid, structural support with a support cable. It may be challenging, however, to access internal modules of a remote unit during servicing, and such challenges may be compounded when support cables are engaged. It may also be challenging to access entire surfaces or sides of electronic components of remote units to permit servicing operations without dismounting and re-mounting such electronic components. It may also be cumbersome to mount a remote unit in a drop ceiling, particularly after a drop ceiling grid has been installed and if a remote unit has length and width dimensions that exceed a conventional drop ceiling grid opening.

No admission is made that any reference cited herein constitutes prior art. Applicant reserves the right to challenge the accuracy and pertinence of any cited documents.

SUMMARY

Remote unit assemblies for distributed communication systems and related accessing methods are provided. An exemplary remote unit assembly includes a support member (e.g., a support plate) configured to be mounted in a drop ceiling grid, and a pivot arm supported by the support member and configured to receive an electronic component to permit the electronic component to pivot between a substantially horizontal position and a substantially vertical position. Various embodiments include features that enhance user safety, facilitate efficient installation, and/or promote enhanced serviceability of electronic components. As one example, a remote unit assembly according to certain embodiments includes a slow release mechanism configured to reduce a rate of pivotal motion of the pivot arm and an electronic component relative to an uncontrolled rate of pivotal motion motivated by gravity, thereby preventing the pivot arm and electronic component from pivoting at a high rate of speed and possibly injuring a user (e.g., maintenance personnel). As another example, a remote unit assembly according to certain embodiments includes a support plate defining an aperture, with the electronic component received below a pivot arm supported above the support plate, and with a retention mechanism associated with the support plate being configured to engage the electronic component to retain the electronic component in a substantially horizontal position. The retention mechanism includes a user-accessible actuation element accessible at or along a lower surface of the support plate, and a portion of the pivot arm is configured to travel through the aperture when the electronic component pivots between the substantially horizontal position and a substantially vertical position. Preferably, an aperture-defining support plate is sized and shaped to replace a conventional ceiling tile, and is devoid of a frame along peripheral edges thereof, to permit the support plate to reside within a conventional drop ceiling grid without modification to the drop ceiling grid. As another example, a remote unit assembly according to certain embodiments includes an antenna cover arranged below an electronic component, which promotes an aesthetic appearance but also permits a remote antenna unit to be easily located. An antenna cover placed below a drop ceiling grid may further include an embedded or integrated antenna, with such antenna placement reducing signal attenuation relative to placement of an antenna in equipment mounted above a drop ceiling grid. An antenna cover desirably includes ventilation openings arranged proximate to the portion of the electronic component arranged below the aperture to allow heat generated by the electronic component to be dissipated into an ambient environment. At least one pivotal link configured to permit pivotal movement between the antenna cover and the electronic component is preferably provided to permit the antenna cover to pivot between a closed position and an open position (e.g., hanging below the electronic component) to enhance access to the electronic component for servicing thereof without requiring dismounting and remounting of the electronic component.

One embodiment of the disclosure relates to a remote unit assembly for a (DCS). The remote unit assembly comprises a support member configured to be mounted in a drop ceiling grid, a pivot arm supported by the support member, and a slow release mechanism. The pivot arm is configured to receive an electronic component and to permit the electronic component to pivot between a substantially horizontal position and a substantially vertical position. The slow release mechanism is configured to reduce a rate of pivotal motion of the pivot arm and the electronic component between the substantially horizontal position and the substantially vertical position, relative to an uncontrolled rate of pivotal motion motivated by gravity.

An additional embodiment of the disclosure relates to a remote unit assembly for a distributed communications system. The remote unit assembly comprises a support plate configured to be mounted in a drop ceiling grid and defining an aperture, an electronic component, a pivot arm supported above the support plate, and at least one retention mechanism associated with the support plate. The pivot arm is configured to receive the electronic component below the pivot arm and to permit the electronic component to pivot between a substantially horizontal position and a substantially vertical position. The pivot arm is arranged above the drop ceiling grid when the electronic component is in the substantially horizontal position. A portion of the pivot arm is configured to travel through the aperture when the electronic component pivots between the substantially horizontal position and the substantially vertical position. The at least one retention mechanism is configured to selectively engage the electronic component to retain the electronic component in the substantially horizontal position, and includes a user-accessible actuation element accessible at or along a lower surface of the support plate.

Another embodiment of the disclosure relates to a method of accessing a remote unit assembly for a distributed communications system (DCS). The remote unit assembly includes an electronic component, a support plate configured to be mounted in a drop ceiling grid, a pivot arm supported above the support plate and being configured to receive the electronic component below the pivot arm and to permit the electronic component to pivot between a substantially horizontal position and a substantially vertical position. The method includes pivoting the pivot arm and the electronic component from the substantially horizontal position to the substantially vertical position, wherein said pivoting causes a portion of the pivot arm to travel through an aperture defined in the support plate, and accessing the electronic component. Additional method steps disclosed herein may also be performed.

Additional features and advantages will be set forth in the detailed description which follows and in part will be readily apparent to those skilled in the art from the description or recognized by practicing the embodiments as described in the written description and claims hereof, as well as the appended drawings.

It is to be understood that both the foregoing general description and the following detailed description are merely exemplary and are intended to provide an overview or framework to understand the nature and character of the claims.

The accompanying drawings are included to provide a further understanding and are incorporated in and constitute a part of this specification. The drawings illustrate one or more embodiment(s) and, together with the description, serve to explain principles and operation of the various embodiments.

DETAILED DESCRIPTION

Figure 1:
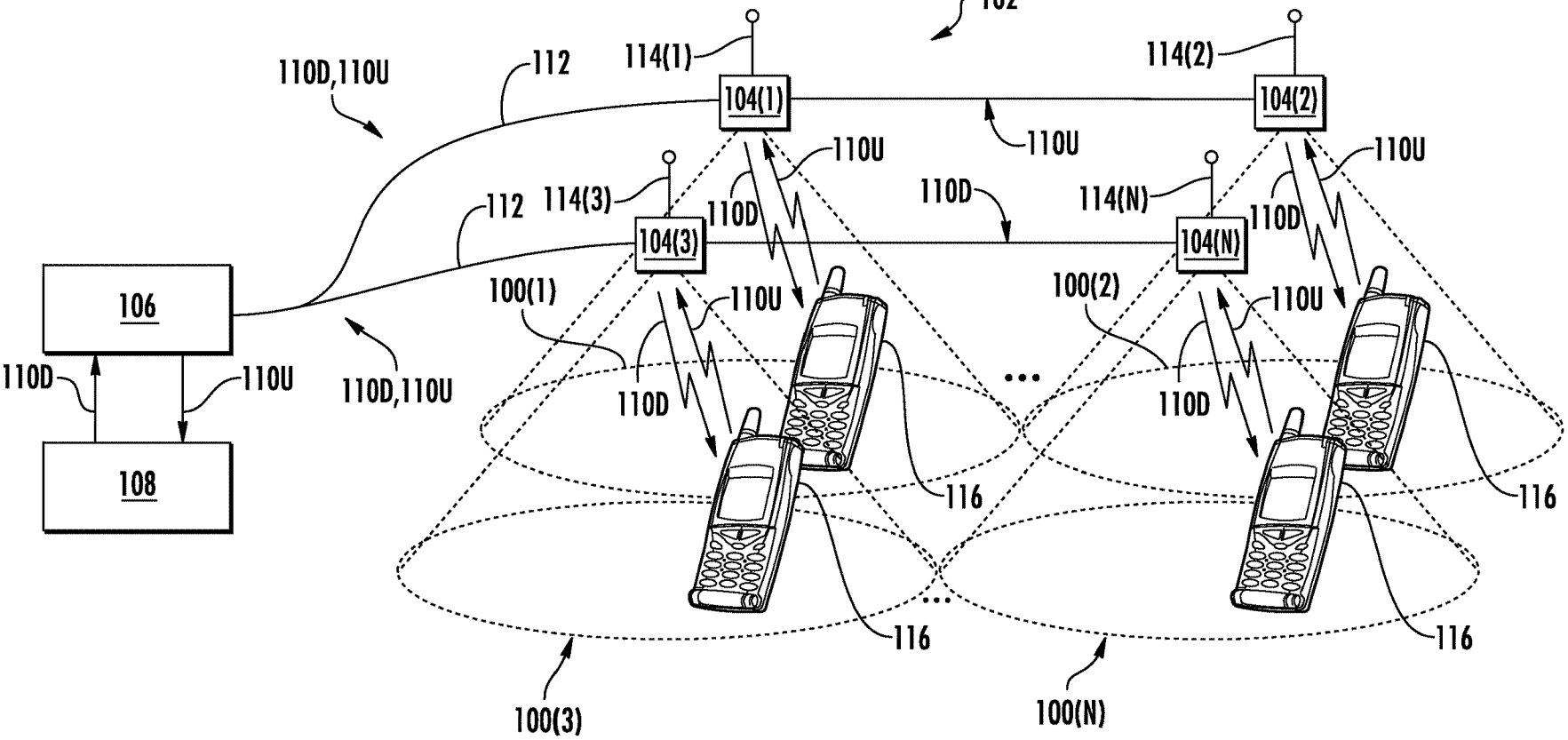
FIG. 1 is a schematic diagram of an exemplary distributed communications system (DCS)

Remote unit assemblies for distributed communication systems and related accessing methods are provided. An exemplary remote unit assembly includes a support member (e.g., a support plate) configured to be mounted in a drop ceiling grid, and a pivot arm supported by the support member and configured to receive an electronic component to permit the electronic component to pivot between a substantially horizontal position and a substantially vertical position. Various embodiments include features that enhance user safety, facilitate efficient installation, and/or promote enhanced serviceability of electronic components. As one example, a remote unit assembly according to certain embodiments includes a slow release mechanism configured to reduce a rate of pivotal motion of the pivot arm and an electronic component relative to an uncontrolled rate of pivotal motion motivated by gravity, thereby preventing the pivot arm and electronic component from pivoting at a high rate of speed and possibly injuring a user (e.g., maintenance personnel). As another example, a remote unit assembly according to certain embodiments includes a support plate defining an aperture, with the electronic component received below a pivot arm supported above the support plate, and with a retention mechanism associated with the support plate being configured to engage the electronic component to retain the electronic component in a substantially horizontal position. The retention mechanism includes a user-accessible actuation element accessible at or along a lower surface of the support plate, and a portion of the pivot arm is configured to travel through the aperture when the electronic component pivots between the substantially horizontal position and a substantially vertical position. Preferably, an aperture-defining support plate is sized and shaped to replace a conventional ceiling tile, and is devoid of a frame along peripheral edges thereof, to permit the support plate to reside within a conventional drop ceiling grid without modification to the drop ceiling grid. As another example, a remote unit assembly according to certain embodiments includes an antenna cover arranged below an electronic component, which promotes an aesthetic appearance but also permits a remote antenna unit to be easily located. An antenna cover placed below a drop ceiling grid may further include an embedded or integrated antenna, with such antenna placement reducing signal attenuation relative to placement of an antenna in equipment mounted above a drop ceiling grid. An antenna cover desirably includes ventilation openings arranged proximate to the portion of the electronic component arranged below the aperture to allow heat generated by the electronic component to be dissipated into an ambient environment. At least one pivotal link configured to permit pivotal movement between the antenna cover and the electronic component is preferably provided to permit the antenna cover to pivot between a closed position and an open position (e.g., hanging below the electronic component) to enhance access to the electronic component for servicing thereof without requiring dismounting and remounting of the electronic component.

As used herein, a "substantially horizontal position" may describe a position that is level (e.g., 90 degrees from vertical) or nearly level (e.g., 90±3 degrees from vertical, 90±5 degrees from vertical, 90±10 degrees from vertical, or 90±15 degrees from vertical in certain embodiments). As used herein, a "substantially vertical position" may describe a position that is upright (e.g., 90 degrees from horizontal) or nearly upright (e.g., 90±3 degrees from horizontal, 90±5 degrees from horizontal, 90±10 degrees from horizontal, or 90±15 degrees from horizontal in certain embodiments). In certain embodiments, a ceiling is substantially parallel to a floor in a particular environment. In other embodiments, a ceiling may be inclined at any suitable angle relative to a floor in a particular environment.

Various embodiments will be further clarified by the following examples.

Figure 2B:
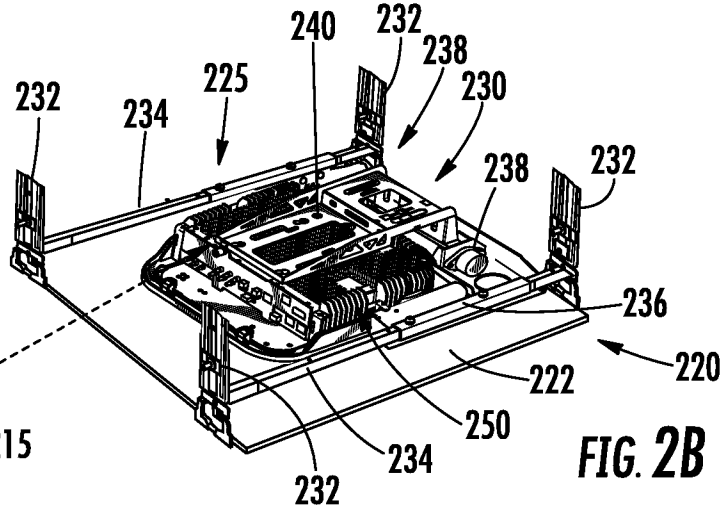
FIG. 2B is an upper perspective view of the remote unit assembly in FIG. 2A, with electronic components supported by a pivot arm of a lift bracket in a horizontal position suitable for operation.
Figure 2C:
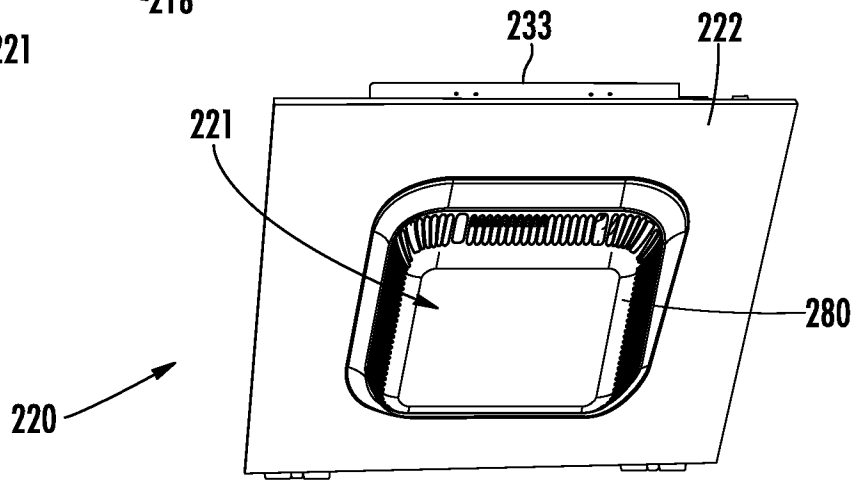
FIG. 2C is a lower perspective view of the remote unit assembly in FIG. 2A, but omitting remote supports.
Figure 2A:
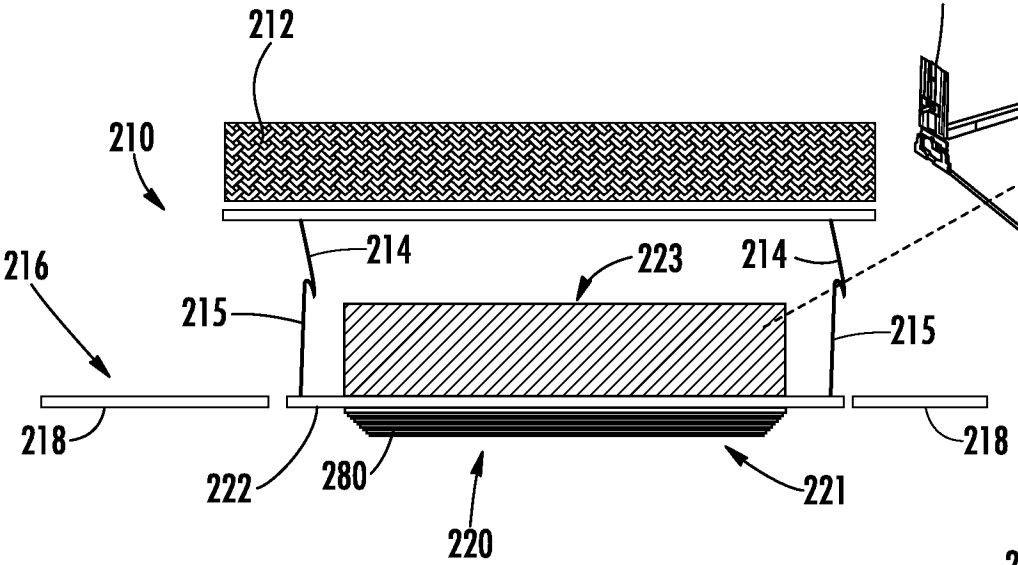
FIG. 2A is a side elevation schematic view of a remote unit assembly for a DCS according to a first embodiment mounted to a ceiling structure.

FIG. 2A is a side elevation schematic view of a remote unit assembly 220 for a distributed communication system (DCS) according to a first embodiment, with the remote unit assembly being mounted to a ceiling structure 212. FIG. 2B and FIG. 2C provide more detailed upper perspective and lower perspective views, respectively, of the remote unit assembly 220.

Referring to FIG. 2A, the exemplary ceiling structure 212 is a suspended or drop ceiling structure, in which a secondary or drop ceiling 216 is hung below a ceiling structure 212. The secondary or drop ceiling 216 is typically visible to persons located in the environment below the ceiling structure 210. The secondary or drop ceiling 216 is a generally planar structure constructed of one or more planar components. A common configuration is a series of rectangular panels (or "tiles") mounted in a supporting drop ceiling grid. In the illustrated embodiment, ceiling tiles 218 are adjacent the remote unit assembly 220. The exemplary structural ceiling 212 is a relatively rigid structure meant to support structural loads. As shown in FIG. 2A, a lower or front side 221 of the remote unit assembly 220 including an antenna cover 280 is arranged generally below the secondary or drop ceiling 216, and an upper or back side 223 of the remote unit assembly 221 is arranged generally between secondary or drop ceiling 216 and the ceiling structure 212.

Referring to FIG. 2A and FIG. 2B, the remote unit assembly 220 includes an electronic component 250 and a mounting component 225 and may be configured to occupy a location in a drop ceiling grid normally occupied by a standard drop ceiling tile. The electronic component 250 may include, for example, an antenna unit for transmission of radio frequency (RF) signals into and reception of RF signals (including, for example, voice and/or data information) from an RF coverage area, and supporting electronics such as an electronics board attached to a heat sink configured to dissipate the heat generated by the electronic components. The electronics board may carry out processing and conversion functions described with reference to remote units. An antenna cover 280 is provided to conceal the electronic component 250 from the view of persons in the coverage area and optionally may include an antenna (e.g., embedded or otherwise integrated in the antenna cover 280) operatively coupled to the electronic component 250. Providing an antenna within the antenna cover 280 may beneficially reduce signal attenuation relative to placement of an antenna in equipment mounted above a drop ceiling grid.

As shown in FIG. 2B, the mounting component 225 may include, for example, a support plate 222 connected to a support frame 230 including two pairs of upwardly extending remote supports 232 that may be used to mount the remote unit assembly 220 to the ceiling structure 210 using support cables 215 (shown in FIG. 2A). The support plate 222 is preferably sized and shaped to replace a conventional ceiling tile, and is preferably devoid of a frame along peripheral edges thereof, to permit the support plate 222 to reside within a conventional drop ceiling grid without modification to the drop ceiling grid. Each pair of remote supports 232 is connected by a rail 234 extending across the support plate 222. The rails 234 may be relatively rigid structural components designed to support the weight of the electronic component 250 and can be made from, for example, metals, rigid plastics, and/or other materials. A lateral brace 233 may further extend between the rails 234. Support cables 215 can be connected to the support frame 230 (e.g., via remote supports 232 shown in FIG. 2B) and can connect to structural supports 214 extending downwardly from and anchored to the structural ceiling 212. The support cables 215 can be configured to support all or a part of the electronic component 250 and the support frame 230.

The support frame 230 includes a carrier or lift bracket 236 having pivots 238 that pivotably support a pivot arm 240 connected to the electronic component 250. Preferably, the pivots 238 include a slow release mechanism such as a rotary damper to reduce a rate of pivotal motion of the pivot arm 240 relative to an uncontrolled rate of pivotal motion motivated by gravity. The pivot arm 240 is capable of pivoting downwardly to facilitate access to the electronic component 250 from below. In the illustrated embodiment shown in FIG. 2B, the carrier or lift bracket 236 is supported by the rails 234 of the support frame 230. Providing the pivots 238 with a slow release mechanism prevents the pivot arm 240 and the electronic component 250 from pivoting at a high rate of speed and possibly injuring a user (e.g., maintenance personnel) when the electronic component 250 and the pivot arm 240 are released from a horizontal position to permit servicing.

The structure and arrangement of the remote unit assembly 220 will be further discussed with reference to FIGS. 3A-8, which also illustrate a method of accessing the remote unit assembly 220.

Figure 3B:
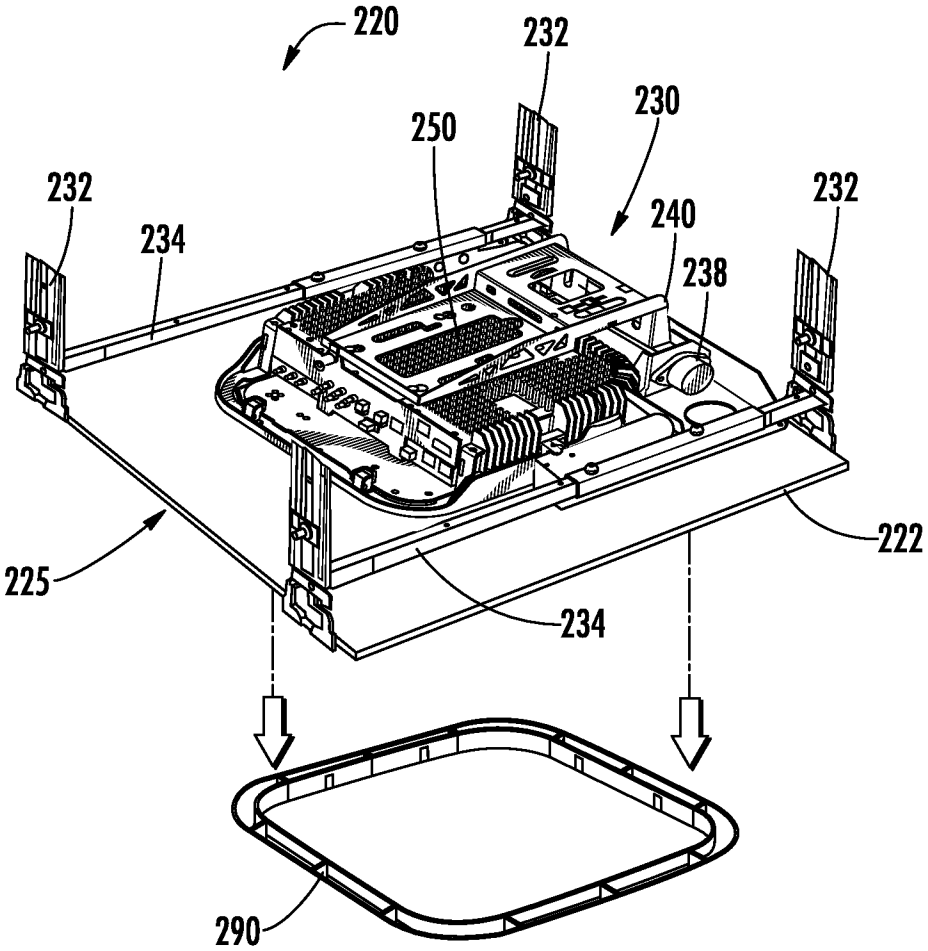
FIG. 3B is an upper perspective disassembly view of the remote unit assembly in FIG. 3A, following removal of the trim ring.
Figure 3A:
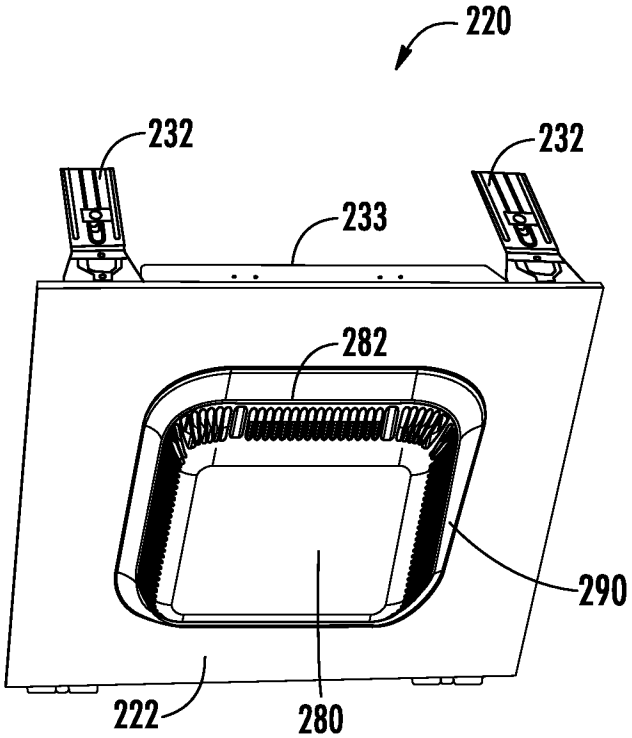
FIG. 3A is a lower perspective view of the remote unit assembly in FIG. 2A with remote supports and additionally including a trim ring arranged along a perimeter of the antenna cover and configured to promote an aesthetic appearance by covering a gap that would otherwise be visible between the antenna cover and an aperture defined in a support plate.

FIG. 3A is a lower perspective view of the remote unit assembly 220 according to the first embodiment, including a trim ring 290 arranged to surround the antenna cover 280 along a lower surface of the support plate 222. As shown, the antenna cover 280 includes openings or vents 282 around a lateral surface thereof to enable heat generated by at least one electronic component 250 to be dissipated into an ambient environment. Remote supports 232 and the lateral brace 233 are further shown extending upward from top surface of the support plate 220.

FIG. 3B is an upper perspective disassembly view of the remote unit assembly 200 according to the first embodiment, showing a first exemplary step in accessing the unit, in which a trim ring 290 of the antenna cover 280 is removed, by pulling the trim ring 290 away from a lower surface of the support plate 222. The trim ring 290 is arranged along a perimeter of the antenna cover 280 is configured to promote an aesthetic appearance of the remote unit assembly 200 by covering a gap that may otherwise be visible between the antenna cover 280 and an aperture 224 (shown in FIG. 5) defined in the support plate 222, and by covering retention mechanism actuation members 262 (shown in FIG. 4B) accessible to a user along a lower surface of the support plate 222. As shown in FIG. 3B, the mounting component 225 includes the support plate 222 and support frame 230 that includes remote supports 232, rails 234, carrier or lift bracket 236, and pivot arm 240 supported by pivots 238.

Figures 4A, 4B:
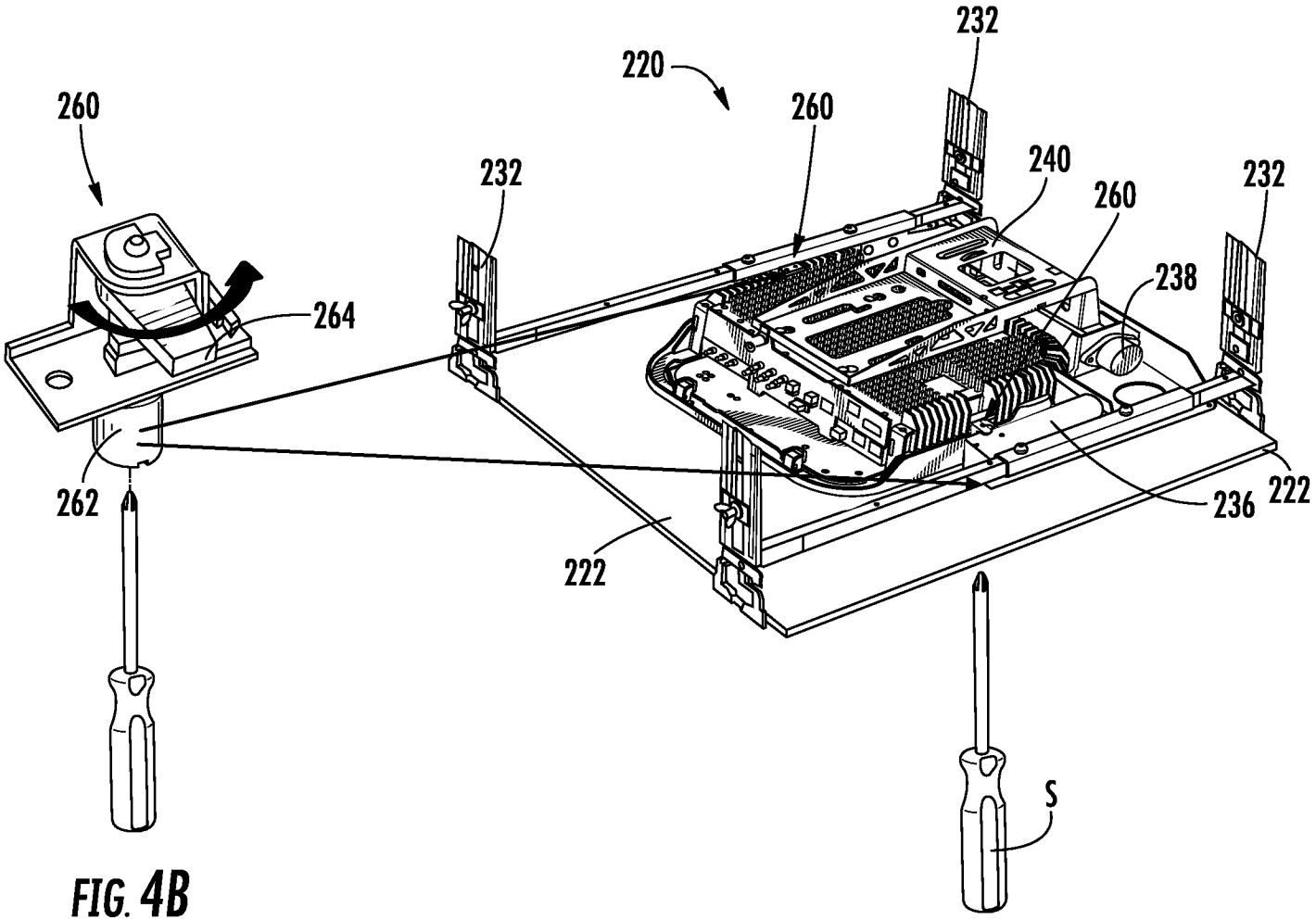
FIG. 4A is an upper perspective view of the remote unit assembly in FIGS. 2A to 3B with a screwdriver positioned below a retaining device of the remote unit assembly.
FIG. 4B is a magnified upper perspective view of the retaining device and screwdriver of FIG. 4A.

FIGS. 4A-4B illustrate an exemplary step in which retention mechanisms 260 engageable to sides of the electronic component 250 are disengaged from contact with an upper surface of the support plate 222 to allow the electronic component 250 to pivot downwardly and away from a structural ceiling (not shown). The retention mechanisms 260 can each include a downwardly projecting actuation member 262 that is connected to a tab 264 and is designed to rotate about a longitudinal (e.g., vertical) axis. During routine operation of the remote unit assembly 220 (e.g., not during servicing), the tabs 264 rest on an upper surface of the support frame 230, such as at the support plate 222, and can support a part of or all of the weight of the electronic component 250. Each actuation member 262 is accessible to a user along a lower surface of the support plate 222. The retention mechanisms 260 can be disengaged by rotating the actuation member 262, such as by engagement with a tool (e.g., a screwdriver S), to cause the tabs 264 to rotate out of engagement with the support plate 222. In such a state, the pivot arm 240 and the electronic component 250 are able to pivot downwardly about the pivots 238. Providing actuation members 262 along a lower surface of the support plate 222 permits a user to actuate the retention mechanisms 260 from an environment below the remote unit assembly 220.

Figure 5:
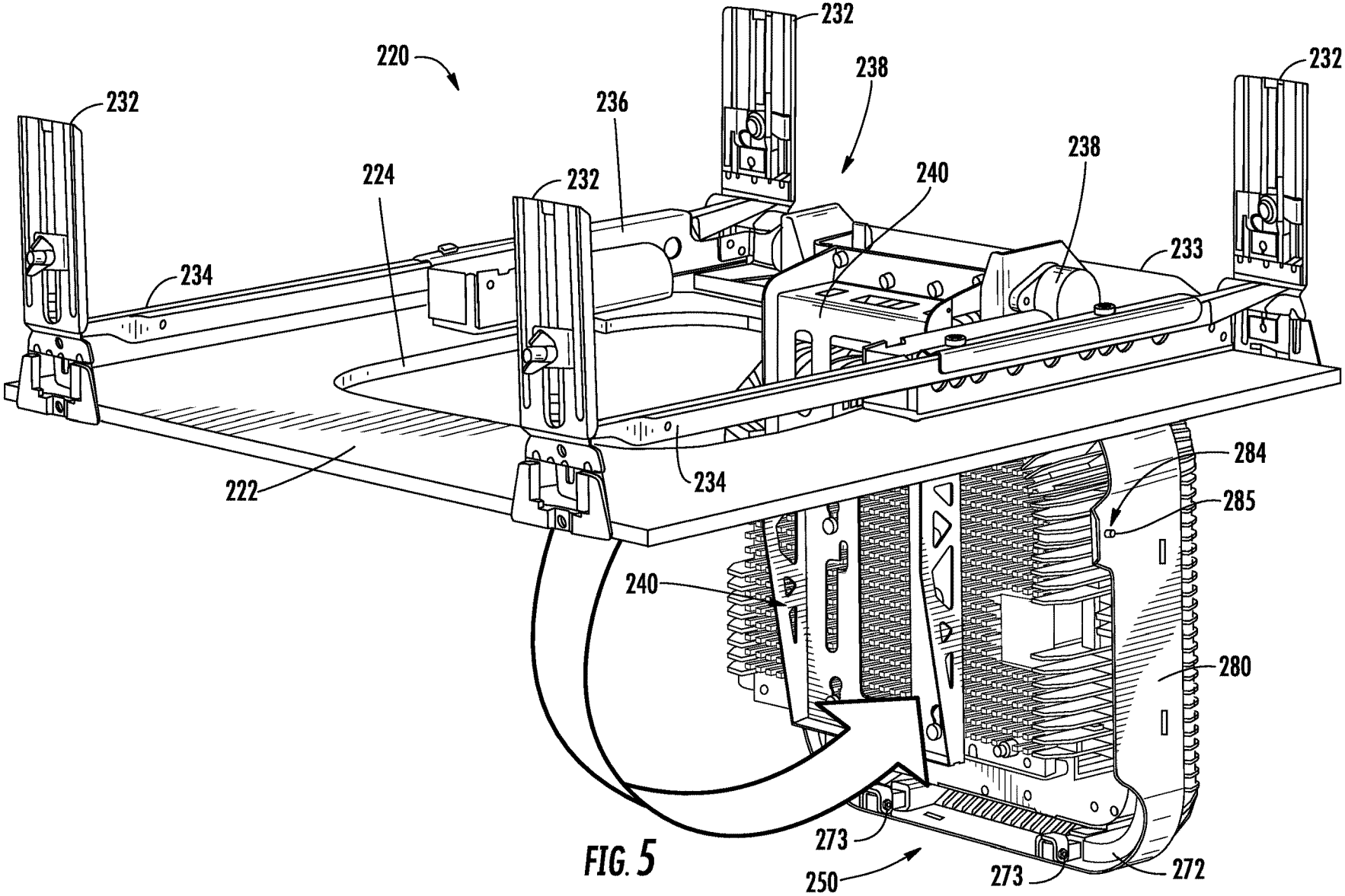
FIG. 5 is a perspective view of the remote unit assembly in FIG. 4A, following pivoting of the electronic components supported by the pivot arm to a vertical position, with an antenna cover of the remote unit assembly in a closed state.

FIG. 5 illustrates an exemplary step in which the pivot arm 240 and electronic component 250 are allowed to pivot downwardly about the first pivot(s) 238 to a substantially vertical position, with the antenna cover 280 in a closed state. The electronic component 250 is supported by the pivot arm 240, which is in turn pivotably mounted to the carrier 236 by the pivots 238. When the electronic component 250 is pivoted downwardly away from a ceiling structure substantially coplanar with the support plate 222, the electronic component 250 and a portion of the pivot arm 240 travel through an aperture 224 in the support plate 222, and the aperture 224 is exposed, thereby allowing access to the support frame 236. In its normal operating condition (i.e., not during servicing), the electronic component 250 is arranged in a substantially horizontal position, with a portion of the electronic component being disposed within the aperture 224. Preferably, a portion of the electronic component 250 extends through the aperture 224 at a level below the support plate 222 when the electronic component 250 is in a horizontal position, to aid in dissipation of heat from the electronic component 250 to an environment below a drop ceiling supporting the remote unit assembly 220, particularly if the antenna cover 280 positioned below the support plate 222 is vented. As shown in FIG. 5, the antenna cover 280 includes ear portions 284 each including a laterally extending cover retention/spring pin 285 that is useable to selectively retain the antenna cover 280 to the electronic component 250. Additionally, pivotal links 272 each having a curved shape are coupled between the antenna cover 280 and the electronic component 250 via hinge members 273 to permit the antenna cover 280 to rotate downward relative to the electronic component 250. In certain embodiments, the pivotal links 272 may further conduct electrical signals between an antenna embedded or otherwise integrated in the antenna cover 280 and the electronic component 250. Integration of an antenna in an antenna cover 280 positioned below a drop ceiling grid may beneficially reduce signal attenuation as compared to placement of an antenna in equipment mounted above a drop ceiling grid.

Figure 6A:
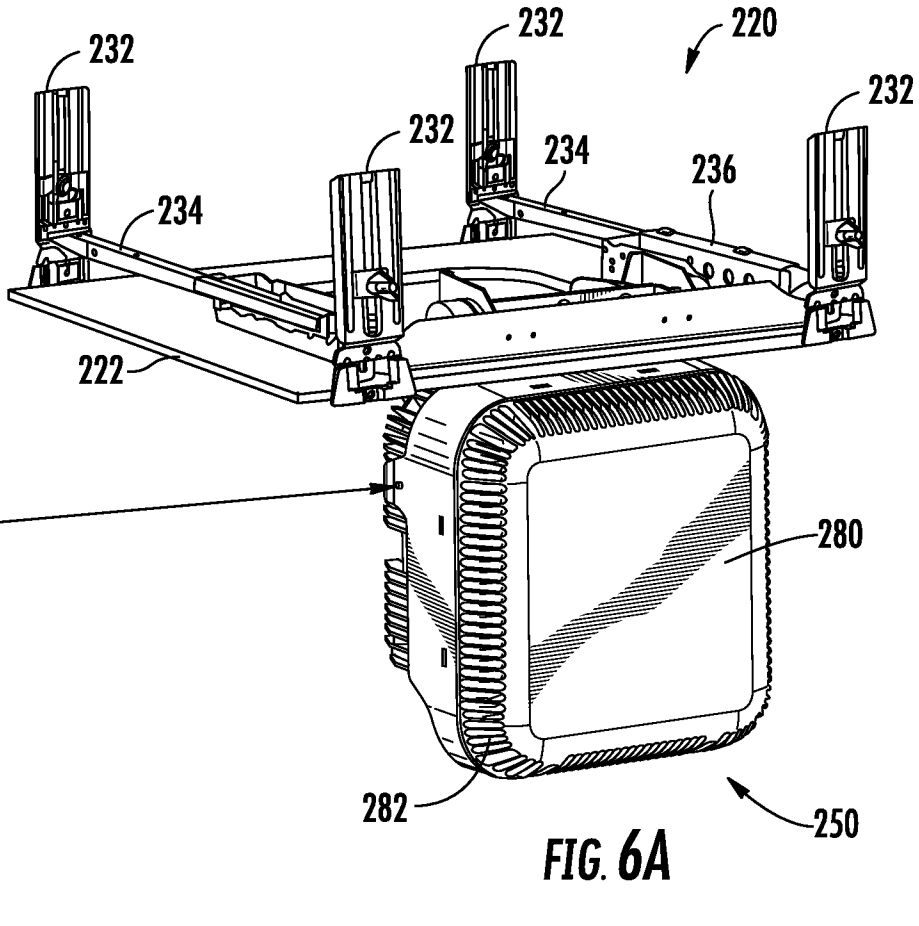
FIG. 6A is a perspective view of the remote unit assembly in FIG. 5 with the electronic components supported by the pivot arm in the vertical position, and with the antenna cover in the closed state.
Figure 6B:
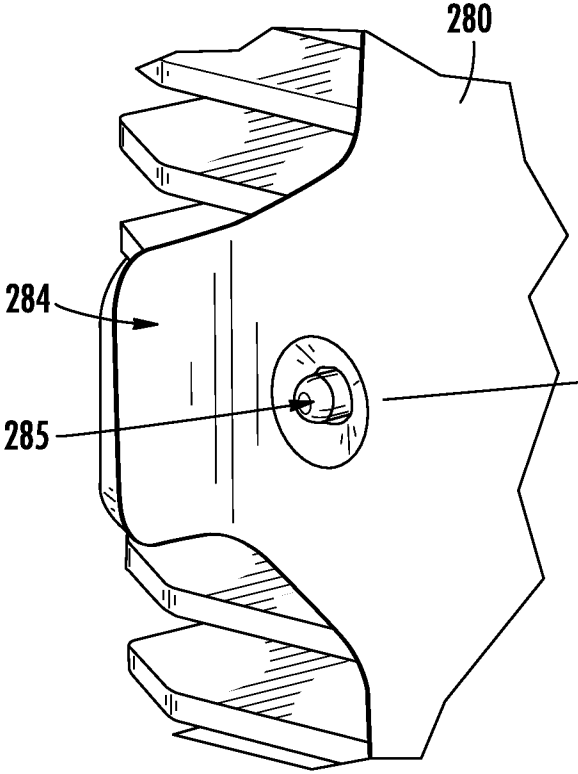
FIG. 6B is a magnified perspective view of a portion of the remote unit assembly in FIG. 6A including an ear portion of the antenna cover defining an aperture configured to receive a laterally projecting cover retention/spring pin to maintain the antenna cover in the closed state.

FIG. 6A is a perspective view of the remote unit assembly 220 according to the first embodiment with the electronic component 250 supported by the pivot arm 240 in a vertical position, and with the antenna cover 280 in the closed state. FIG. 6B is a magnified perspective view of a portion of the remote unit assembly 220 including an ear portion 284 of the antenna cover 280 defining an aperture configured to receive a laterally projecting cover retention/spring pin 285 suitable to maintain the antenna cover 280 in the closed state. Such figures illustrate an exemplary step in which the antenna cover 280 is disengaged to allow access to the electronic component 250. The antenna cover 280 can be disengaged by inwardly pushing one or more pins 285 and outwardly pulling ear portions 284 on either side of the antenna cover 280. The antenna cover 280, including the associated trim ring 290 (shown in FIG. 3B) are generally not intended as structural support members and can be constructed from relatively lightweight rigid materials, such as plastics.

Figure 7B:
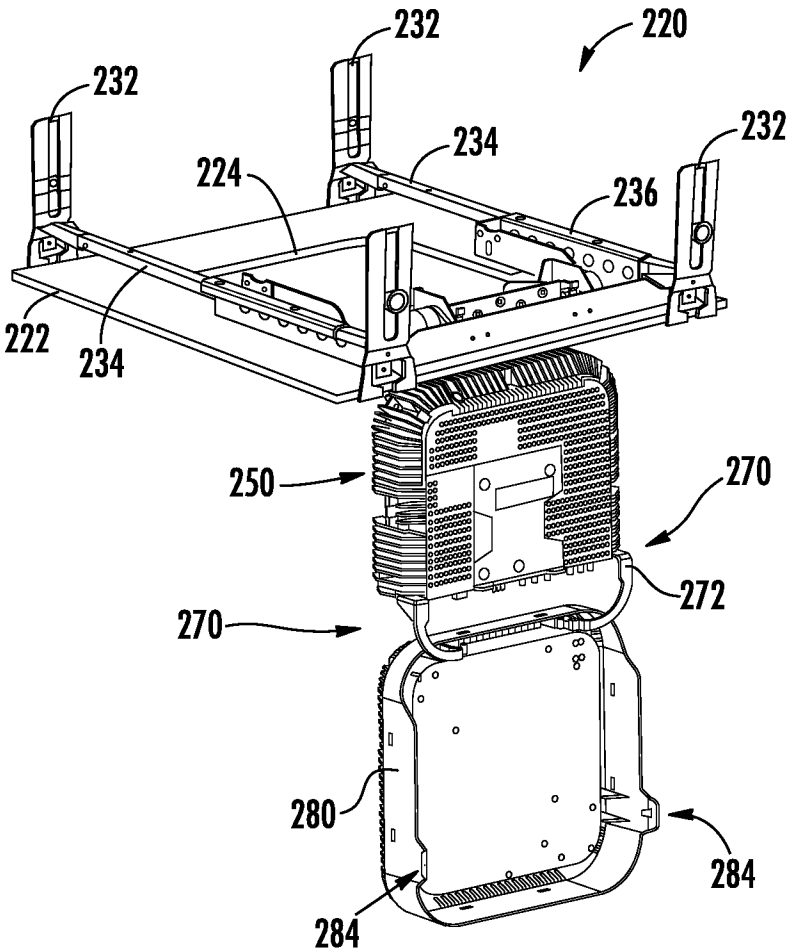
FIG. 7B is a lower perspective view of the remote unit assembly in FIG. 7A with the electronic components (namely, RXU and GEM modules) supported by the pivot arm in the vertical position, and with the antenna cover in the open position, showing a bottom surface of the electronic components and a top surface of the antenna cover.
Figure 7A:
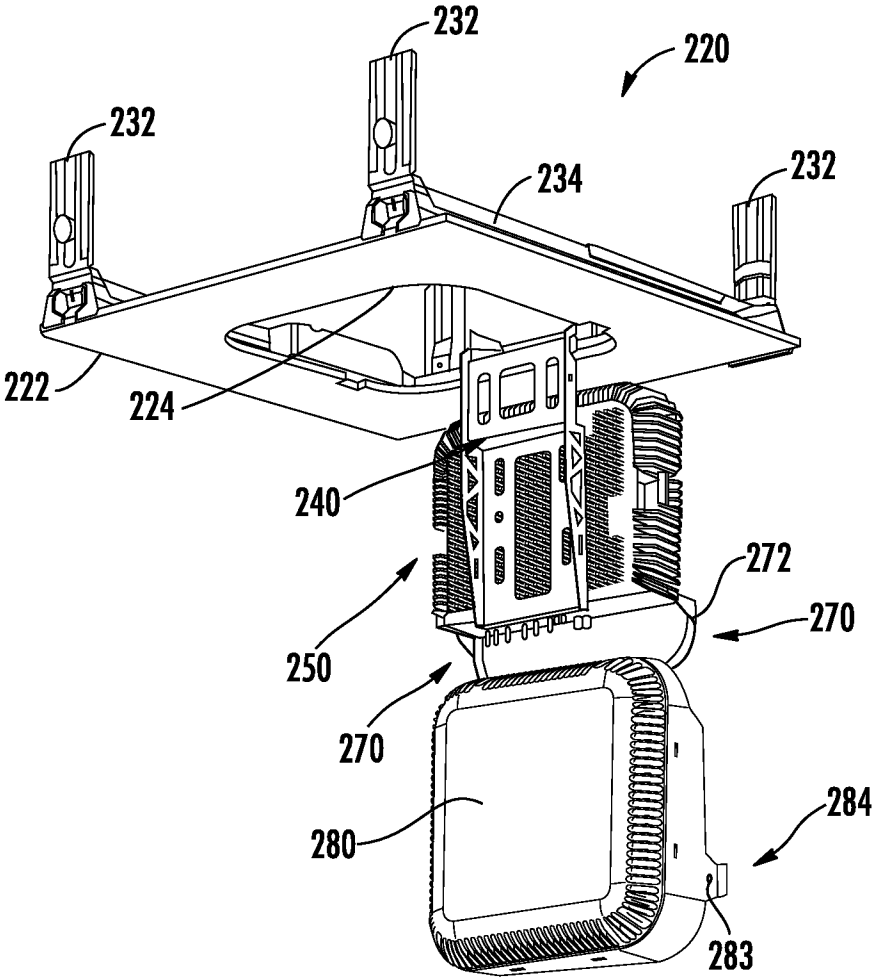
FIG. 7A is a lower perspective view of the remote unit assembly in FIGS. 6A and 6B with the electronic components supported by the pivot arm in the vertical position, and with the antenna cover in an open position, showing a top surface of the electronic components (e.g., a Remote Extender Unit (RXU) module and a Gigabit Ethernet Module (GEM)) and a bottom surface of the antenna cover.

FIGS. 7A-7B illustrate an exemplary step in which the antenna cover 280 is pivoted away from the electronic component 250 to place the electronic component 250 in a user-accessible maintenance or "service" position. FIGS. 7A and 7B are a lower perspective view of the remote unit assembly 220 according to the first embodiment with the electronic components 250 supported by the pivot arm 240 in a vertical position, and with the antenna cover 280 in an open position. The antenna cover 280 is supported by pivotal links 272 arranged on either side of the antenna cover 280 and having associated hinge members 273. In the illustrated embodiment, the pivotal links 272 and associated hinge members 273 (shown in FIG. 5) are pivotably connected to the electronic component 250 and the antenna cover 280 to allow the antenna cover 280 to hang in an open position generally below and away from the electronic component 250. The additional distance between the antenna cover 280 and the electronic component 250 provides easier access to the electronic component 250 when being accessed by technicians, for example. By pivoting the antenna cover 280 away from the electronic component 250, entire surfaces and/or sides of the electronic component 250 (including modules thereof) may be accessed to permit servicing operations without dismounting and re-mounting the electronic component 250 relative to the remote unit assembly 220.

Figure 8:
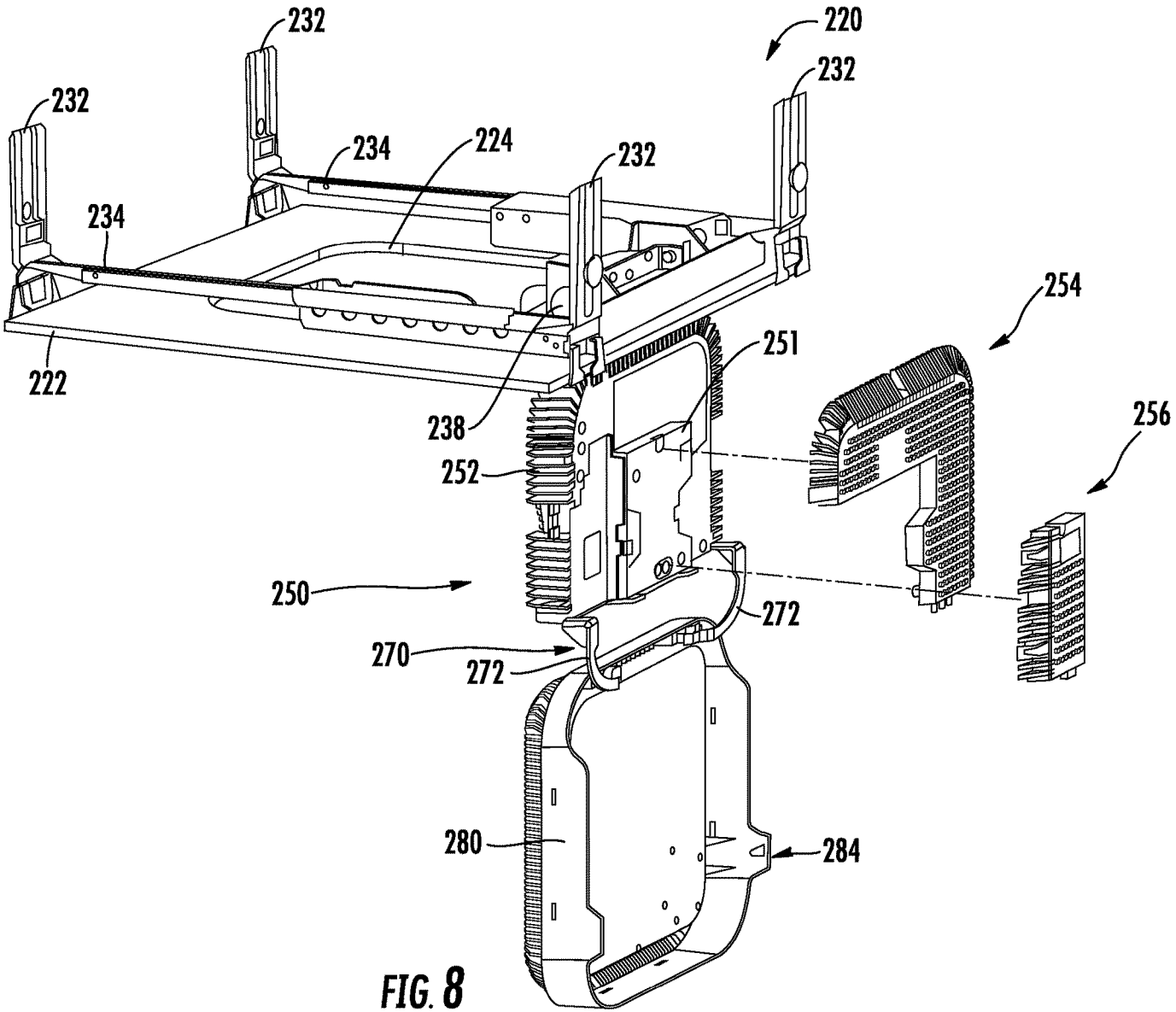
FIG. 8 is a perspective assembly view of the remote unit assembly in FIGS. 7A and 7B with an electronic component supported by the pivot arm in the vertical position, and with the antenna cover in the open position, and showing electronic subcomponents (e.g., RXU and GEM modules) removed from the pivot arm.

FIG. 8 is a perspective assembly view of the remote unit assembly 220 according to the first embodiment with an electronic component 250 supported by the pivot arm 240 in a vertical position, and with the antenna cover 280 (with ear portions 284) in the open position suspended by a joint 270 including the pivotal links 272. Such figure illustrates an exemplary step in which electronic subcomponents 254, 256 are disengaged from a mount 251 and the remainder of the electronic component 250. The electronic subcomponents 254, 256, which may be embodied in discrete modules, can include functional electronics (e.g., circuit boards) designed to, for example, enable additional electromagnetic bands of operation for the electronic component 250, enable additional modes of operation, and other functionalities. In one example, the electronic subcomponents 254, 256 may include a Remote Extender Unit (RXU) module 254 and a Gigabit Ethernet Module (GEM) 256. The electronic component 250 further includes a heat sink 252 that may be embodied in multiple fins. Pivoting the antenna cover 280 away from the electronic component 250 permits the electronic subcomponents 254, 256 to be accessed (e.g., removed, replaced, or otherwise serviced) without dismounting and re-mounting the electronic component 250 relative to the remote unit assembly 220

Figures 9A, 9B, 9C:
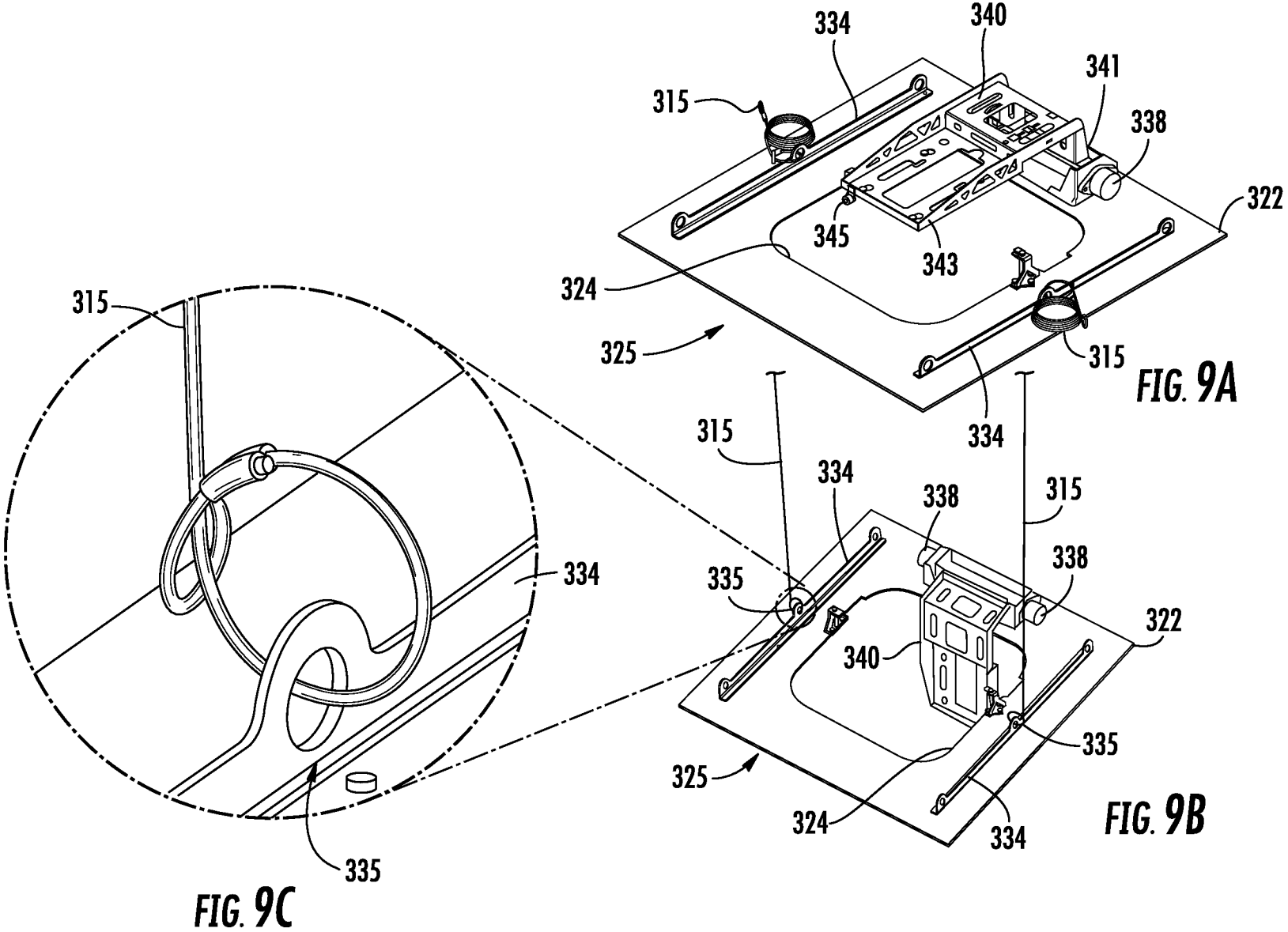
FIG. 9A is an upper perspective view of a mounting component of a remote unit assembly for a DCS according to a second embodiment, including a pivot arm in a horizontal position and including coiled support cables connected to support lugs arranged along a top surface of a support plate.
FIG. 9B is an upper perspective view of the mounting component of the remote unit assembly in FIG. 9A, with the pivot arm in a vertical position and with support cables in an extended state for attachment to an overhead ceiling structure.
FIG. 9C is a magnified upper perspective view of a support lug and support cable of the support plate in FIGS. 9A and 9B.

FIGS. 9A and 9B illustrate a mounting component 325 including a support plate 322 and a pivot arm 340 of a remote unit assembly 320 according to a second embodiment. FIG. 9A shows the pivot arm 340 in a horizontal position, with coiled support cables 315 connected to support lugs arranged along a top surface of the support plate 322. FIG. 9B shows the pivot arm 340 in a vertical position with the support cables 315 coupled to rings or support lugs 335 coupled to the support plate 322 and in an extended state for attachment to an overhead ceiling structure (not shown). The rings or support lugs 335 are joined to rails 334, which are coupled to a top surface of the support plate 322 along either side of a central aperture 324. The rails 334 are positioned inboard from peripheral edges of the support plate 322. Support cables 315 are preferably suspended from a structural ceiling arranged above a drop ceiling grid and are provided as a safety feature to ensure that a remote unit assembly 320 cannot fall on a user positioned below the drop ceiling even if the drop ceiling is rendered incapable of supporting the remote unit assembly 320. The support cables 315 can be, for example, metallic cables looped through the rings or support lugs 335 and/or connected to another support connected to an electronic component to be received by the pivot arm 340 and capable of bearing the load thereof between the cables 315 and the electronic component. A loop on an opposite end of a cable 315 can be engaged with a structural supports (shown in FIG. 1) anchored to and extending downwardly from a structural ceiling. Preferably, the cables 315 are designed to accommodate the entire weight of the electronic component and the mounting component.

Continuing to refer to FIGS. 9A and 9B, a pivot arm 340, which includes a vertical riser segment 341 and a horizontal spanning segment 343, is pivotally coupled to the support plate 322 via pivots 338. Preferably, the pivots 338 include a slow release mechanism (e.g., a rotary damper) to reduce a rate of pivotal motion of the pivot arm 340. A securement fastener 345 (e.g., a screw) is provided along a terminal portion of the pivot arm 340 to promote attachment between the pivot arm 340 and an electronic component (not shown). FIG. 9C is a magnified upper perspective view of a support lug 335 extending upward from a rail 334 joined to a support plate and receiving a support cable 315. According to one embodiment, the support plate 322 of FIGS. 9A and 9B is a metallic plate stamped from, for example, sheet metal. The rails 334 and/or another support frame may be rigidly attached to the support plate 322 and can be made integral with the support plate 322 by bolts, screws, other fasteners, welding, and/or other fastening means.

Figure 10:
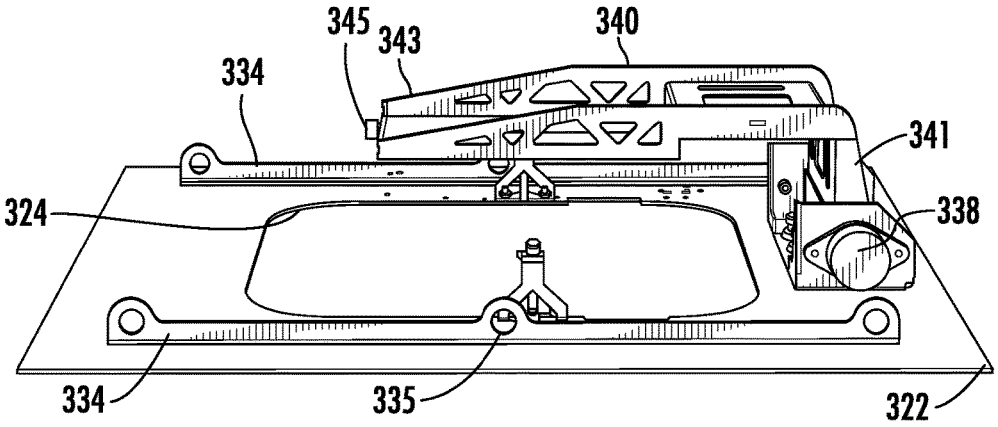
FIG. 10 is a perspective view of the support plate and the pivot arm of the remote unit assembly in FIGS. 9A and 9B, with the pivot arm of a lift bracket in the horizontal position.

FIG. 10 is a perspective view of a mounting component of a remote unit assembly 320 according to the second embodiment, with the pivot arm 340 in a horizontal position. The pivot arm 340 includes a vertical riser segment 341 extending upward from pivots 338 and includes a horizontal spanning segment 343 that receives a securement fastener 345 proximate to a terminal portion of the pivot arm 340. The pivot arm 340 is arranged generally above an aperture 324 defined in the support plate 322, with support rails 334 including lugs 335 positioned along an upper surface of the support plate 322 along either side of the pivot arm 340. As shown, the support rails 334 and the pivot arm 340 are positioned inboard of peripheral edges of the support plate 322, and the support plate 322 is devoid of a peripheral frame at peripheral edges thereof, to permit the support plate 322 to be easily installed and reside in a conventional drop ceiling grid without modification to the drop ceiling grid.

Figure 11:
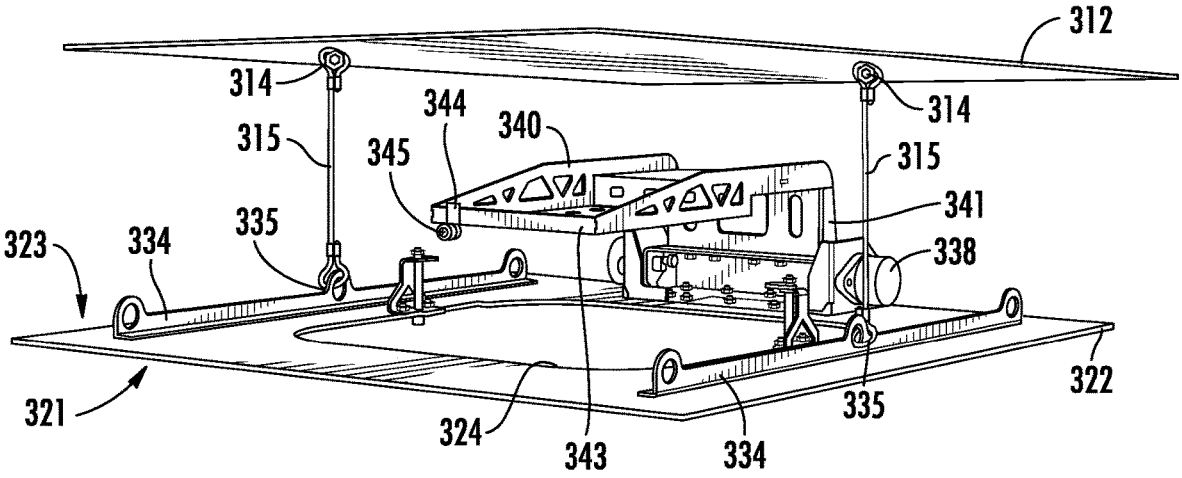
FIG. 11 is a perspective view of the support plate and the pivot arm of the remote unit assembly in FIG. 10, with the pivot arm in the horizontal position, and with support cables extending between support lugs of the support plate and the overhead ceiling structure.

FIG. 11 is a perspective view of the support plate 322 and the pivot arm 340 of the remote unit assembly 320 according to the second embodiment, with support cables 315 extending between support lugs 335 associated with rails 334 and rings 314 or other fasteners mounted to an overhead ceiling structure 312. A ceiling grid that may be provided proximate to the support plate 322 is not shown. The pivot arm 340 is coupled to a support plate 322 with pivots 338 and is shown in a horizontal position. Along a terminal end of the pivot arm 340, a tab 344 extends downward for supporting a securement fastener 345 for securing an electronic component (not shown) to the pivot arm 340. As shown, the pivot arm 340 and rails 334 are positioned above an upper side 323 of the support plate 322, whereas a lower side 321 of the support plate 322 is devoid of protruding structures.

Figure 12:
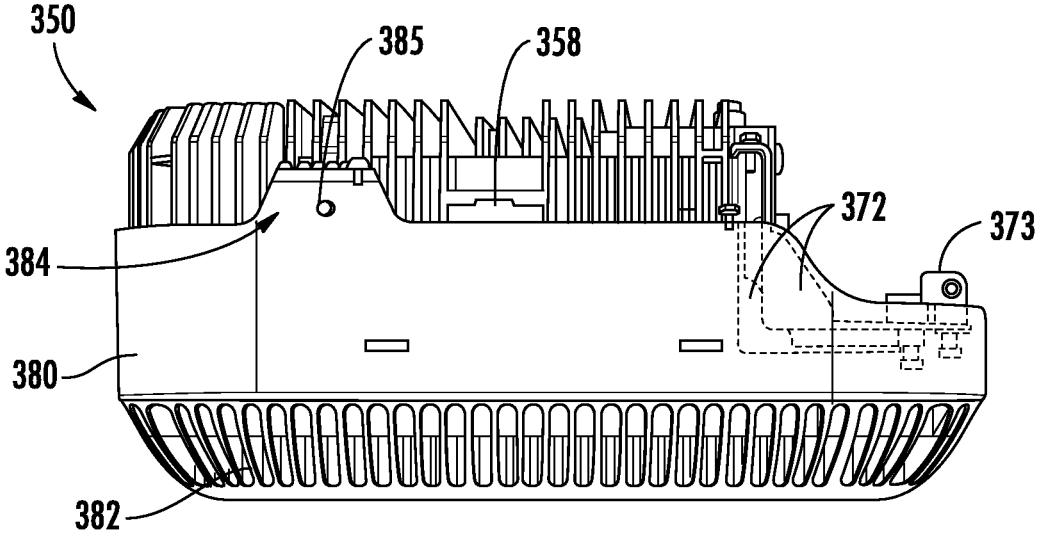
FIG. 12 is a side elevation view of electronic components and an antenna cover of the remote unit assembly in FIG. 11, suitable for being supported by the pivot arm and support plate according to the second embodiment, with the antenna cover in a closed state.

FIG. 12 is a side elevation view of at least one electronic component 350 and an antenna cover 380 of a remote unit assembly 320, suitable for being supported by a pivot arm and support plate (e.g., shown in FIG. 11) according to the second embodiment. As shown, the antenna cover 380 is in a closed state, with an upwardly extending ear portion 384 receiving a laterally extending cover retention/spring pin 385. The antenna cover 380 includes openings or vents 382 around a lower lateral surface thereof to enable heat generated by at least one electronic component 250 to be dissipated into an ambient environment. Pivotal links 372 each having a curved shape are coupled between the antenna cover 380 and the electronic component 350 via hinge members 373 to permit the antenna cover 380 to rotate downward relative to the electronic component 350. Additionally, a side surface of the electronic component 350 defines a lateral recess 358 configured to receive a retention member (not shown) associated with the support plate to permit the electronic component 350 to be selectively retained in the horizontal position relative to the support plate of the remote unit assembly 320.

Figure 13:
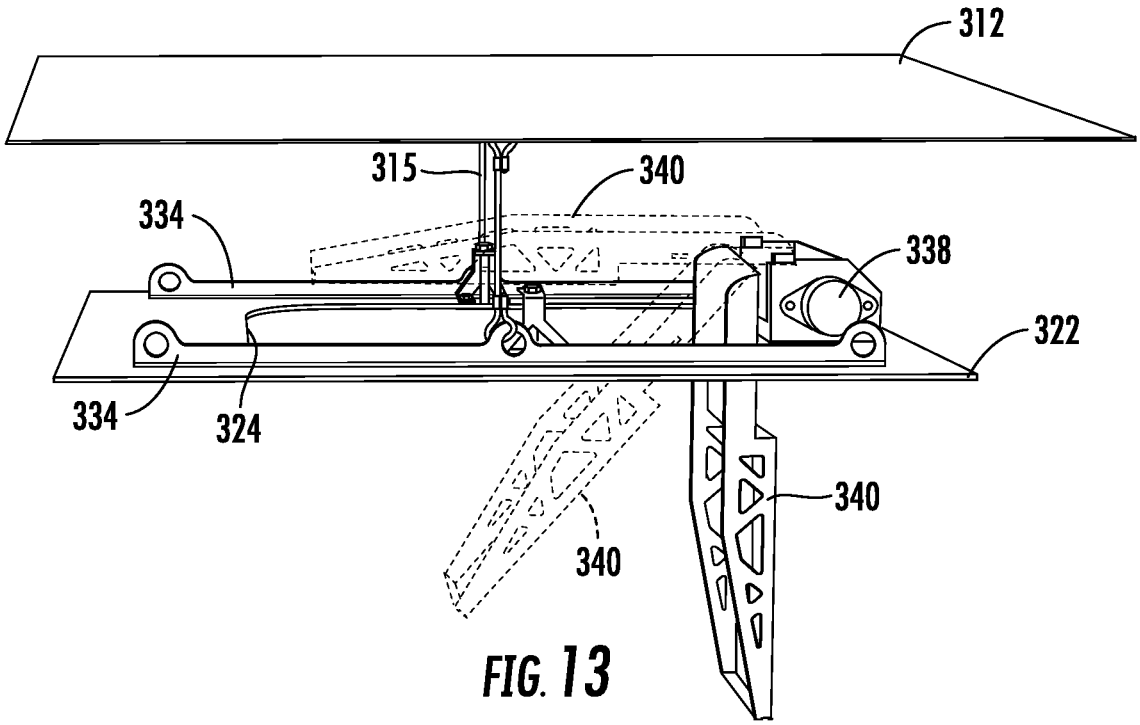
FIG. 13 is a perspective view of the support plate and the pivot arm of the remote unit assembly in FIGS. 11 and 12 with support cables extending between support lugs of the support plate and the overhead ceiling structure, showing the pivot arm in the vertical position in solid lines, and showing the pivot arm in the horizontal position and an intermediate position in dashed lines.

FIG. 13 is a perspective view of the support plate 322 and the pivot arm 340 of the remote unit assembly according to the second embodiment with support cables 315 extending between support lugs of the support plate 322 and an overhead ceiling structure 312, showing the pivot arm 340 in a vertical position in solid lines, and showing the pivot arm 340 in a horizontal position and an intermediate position in dashed lines. The pivot arm 340 is coupled to the support plate 322 with a pivot 338 that preferably includes slow release mechanism. The support plate 322 defines a central aperture 334, and horizontal support rails 334 are arranged on either side of the aperture 324 along a top surface of the support plate 322. As shown, the pivot arm 340 is arranged above the support plate 322 and the aperture 324 when the pivot arm 340 is in a horizontal position, whereas a portion of the pivot arm 340 extends through the aperture 324 when the pivot arm 340 is in the intermediate position or in the vertical position.

Figure 14:
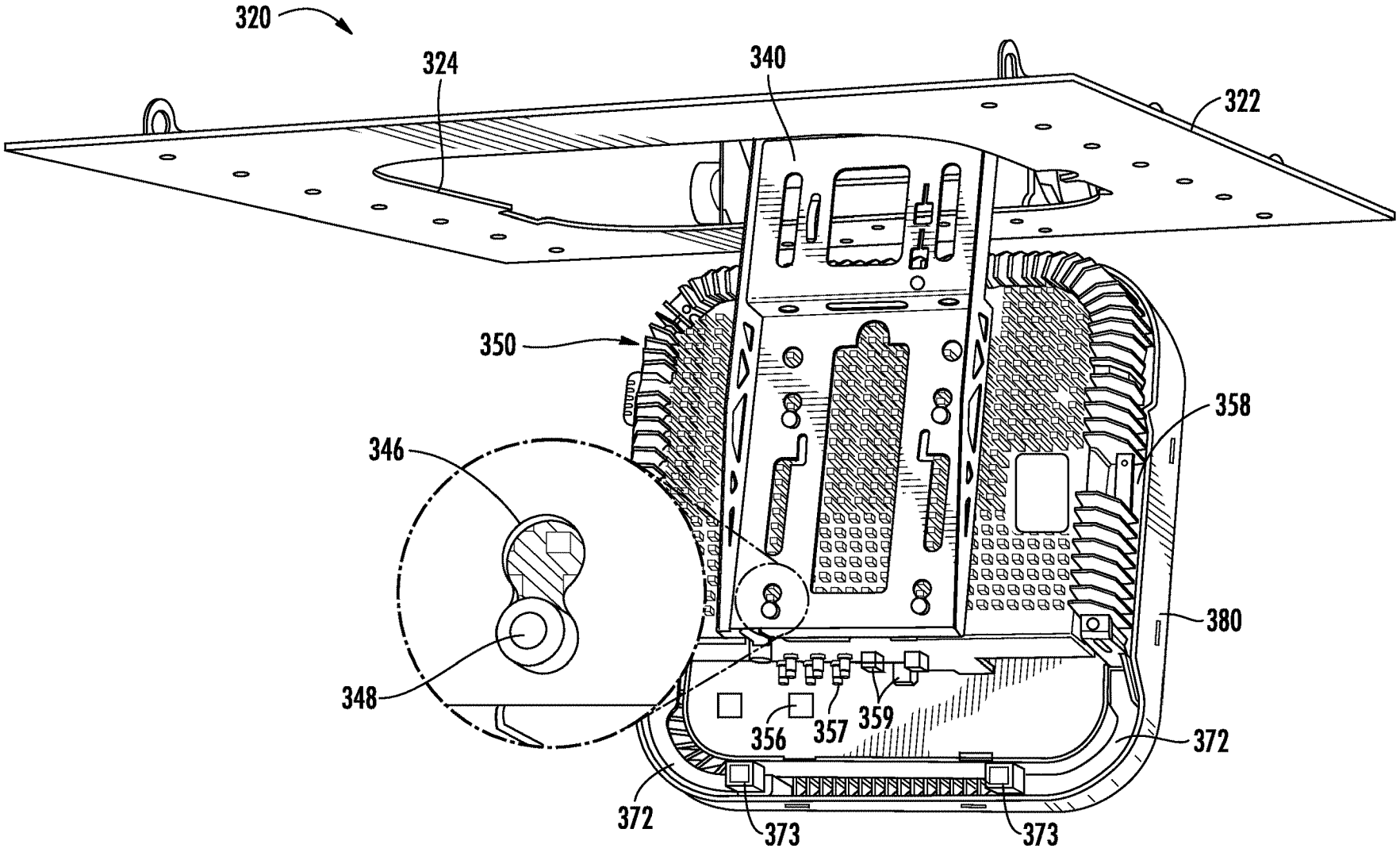
FIG. 14 is a perspective view of the remote unit assembly in FIGS. 12 and 13, showing electronic components and the antenna cover in the closed state supported by the pivot arm in the vertical position, and further including a magnified perspective view of a portion of the pivot arm showing a fastener mounted to the top surface of the electronic component (i.e., RAU module) received within a key slot defined in the pivot arm.

FIG. 14 is a perspective view of a remote unit assembly 320 according to the second embodiment, showing at least one electronic component 350 as well as an antenna cover 380 in a closed state being supported by the pivot arm 340 in a vertical position, extending generally below the support plate 322 and the aperture 324. FIG. 14 further includes a magnified perspective view of a portion of the pivot arm 340 showing a fastener 348 mounted to a top surface of an electronic component 350 being received within a key slot 346 defined in the pivot arm 340. The pivot arm 340 includes four key slots 346 each arranged to receive a respective fastener 348 joined to the electronic component 350. A side surface of the electronic component 350 defines a lateral recess 358 configured to receive a retention member (not shown) associated with the support plate 322 to permit the electronic component 350 to be selectively retained in a horizontal position relative thereto. Pivotal links 372 each having a curved shape are coupled between the antenna cover 380 and the electronic component 350 via hinge members 373 to permit the antenna cover 380 to rotate downward relative to the electronic component 350 between a closed position and an open position. Along an intermediate wall thereof, the electronic component 350 includes coaxial connectors 356 for connection to an antenna, as well as remote antenna unit connectors 357 plus additional connectors 359 for receiving power signals and/or other signals.

Figures 15A, 15B:
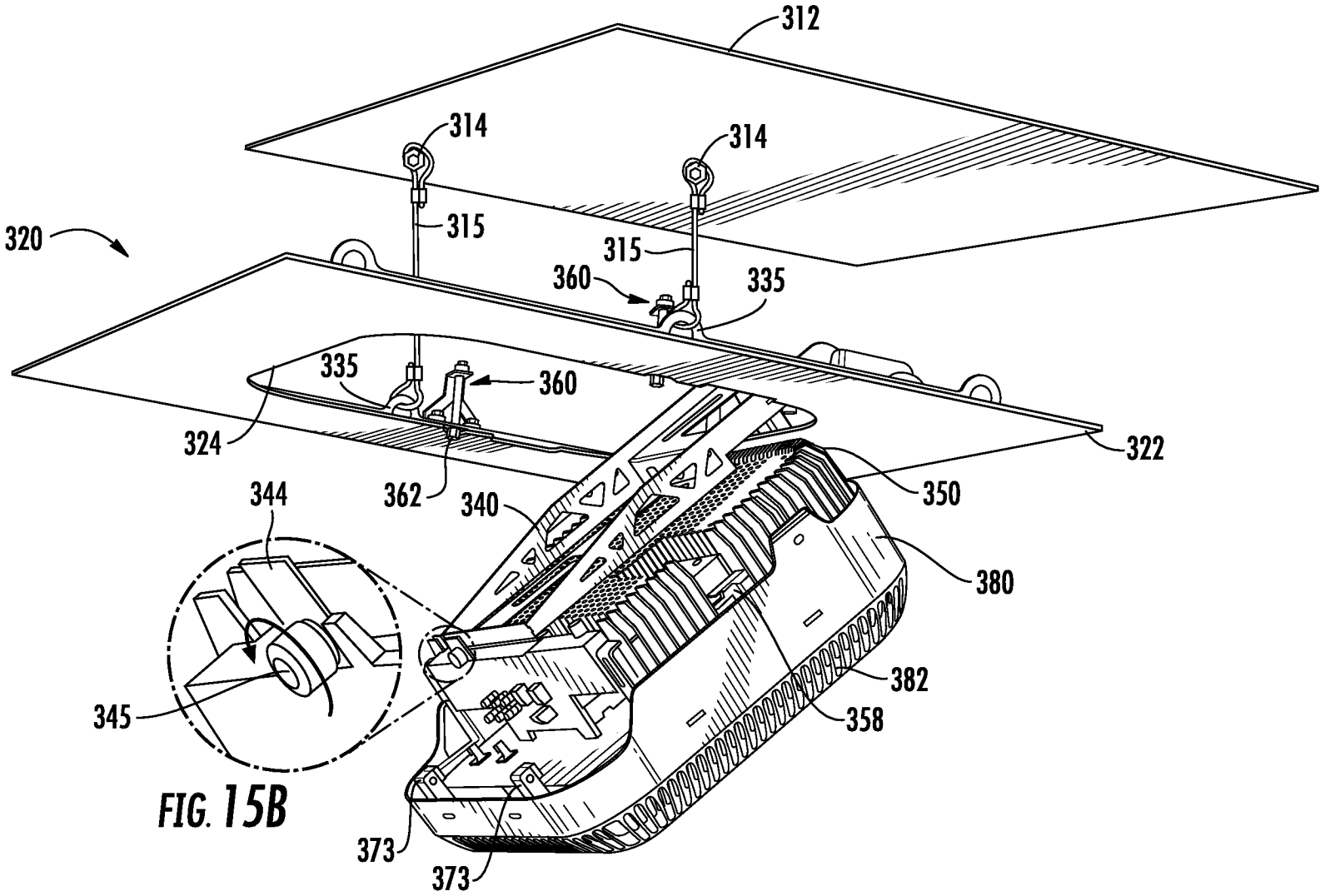
FIG. 15A is a perspective view of the remote unit assembly in FIG. 14 with support cables extending between support lugs of the support plate and the overhead ceiling structure, showing the pivot arm and electronic components in the intermediate position, and showing the antenna cover in the closed state.
FIG. 15B is a magnified perspective view of a portion of the remote unit assembly in FIG. 15A, showing a forwardly extending captive screw for securing an electronic component (e.g., RAU module) to the pivot arm.

FIG. 15A is a perspective view of the remote unit assembly 320 according to the second embodiment with support cables 315 extending between support lugs 335 associated with the support plate 322 and rings 314 or other fasteners coupled to an overhead ceiling structure 312, and showing the pivot arm 340 and electronic components 350 in an intermediate position with the antenna cover 380 in the closed state. FIG. 15B is a magnified perspective view of a portion of the remote unit assembly 320 according to the second embodiment, showing a forwardly extending securement screw 345 supported by a downwardly extending tab 344 for securing electronic components 350 to the pivot arm 340. Referring to FIG. 15A, retention mechanisms 360 are arranged along a top surface of the support plate 322, with each retention mechanism 360 including a movable portion configured to cooperate with a lateral recess 358 defined in a side surface of the electronic component 350 to selectively retain the electronic component 350 in a substantially horizontal position (e.g., when the pivot arm 340 is arranged above the support plate 322). Direct coupling of the retention mechanisms 360 with the electronic component 350, (i.e., rather than with the pivot arm 340), eliminates any need for the pivot arm 340 to span substantially an entire width of the aperture 324 defined in the support plate 322, which might otherwise reduce dissipation of heat generated by the electronic component 350.

Figure 16:
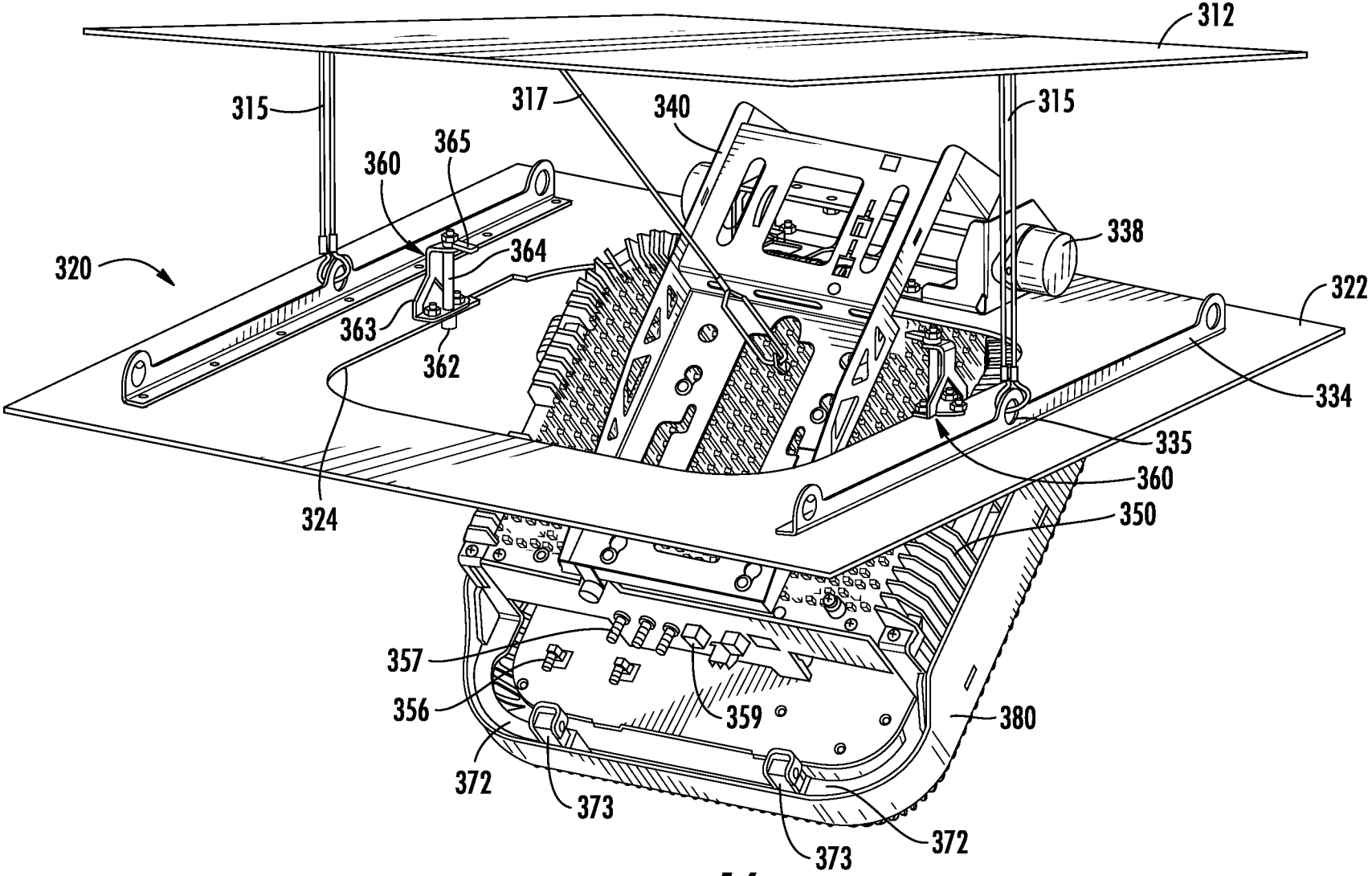
FIG. 16 is a perspective view of the remote unit assembly in FIG. 15A with the pivot arm and electronic components in the intermediate position, with the antenna cover in the closed state, with support cables extending between support lugs of the support plate and the overhead ceiling structure, with a secondary securing cable extending between a top side lug of the electronic component and the overhead ceiling structure.

FIG. 16 is a perspective view of the remote unit assembly 320 according to the second embodiment with the pivot arm 340 and the at least one electronic component 350 in an intermediate position, and with the antenna cover 380 in a closed state. Support cables 315 extend between an overhead ceiling structure 312 and support lugs 335 of rails 334 joined to the support plate 322. Additionally, a secondary securing cable 317 extends between a top side lug of an electronic component 350 and the overhead ceiling structure 312 to ensure that the electronic component 350 cannot inadvertently fall even if it is dismounted from the pivot arm 340. The use of a secondary securing cable 317 attached to the electronic component 350, separate from the support cables 315 associated with the support plate 322, promotes user safety, particularly during a process of mounting or dismounting the electronic component 350 relative to the pivot arm 340. The secondary securing cable 317 preferably has sufficient slack to permit the electronic component 350 to pivot from a substantially horizontal position to a substantially vertical position, but not so much slack that an electronic component 350 removed from the pivot arm 340 could fall and impact a user (e.g., maintenance personnel) positioned below the remote unit assembly 320. Positioned along either side of a central aperture 324 of the support plate 322, slightly inboard of the rails 334, are retention mechanisms 360, each including a framework 363 supporting a vertically oriented shaft 364 extending between rotatable tab 365 and a user-accessible actuation member 362 that extends below the support plate 322. Rotation of the actuation member 362 by a user (e.g., using a screwdriver or other tool) serves to move the rotatable tab 365 to selectively engage a recess defined in a side surface of the electronic component 350 when the electronic component 350 is in the horizontal position. Pivotal links 372 each having a curved shape are coupled between the antenna cover 380 and the electronic component 350 via hinge members 373 to permit the antenna cover 380 to rotate downward relative to the electronic component 350. The electronic component 350 includes coaxial connectors 356 for connection to an antenna, and includes remote antenna unit connectors 357 plus additional connectors 359 for receiving power signals and/or other signals.

Figure 17:
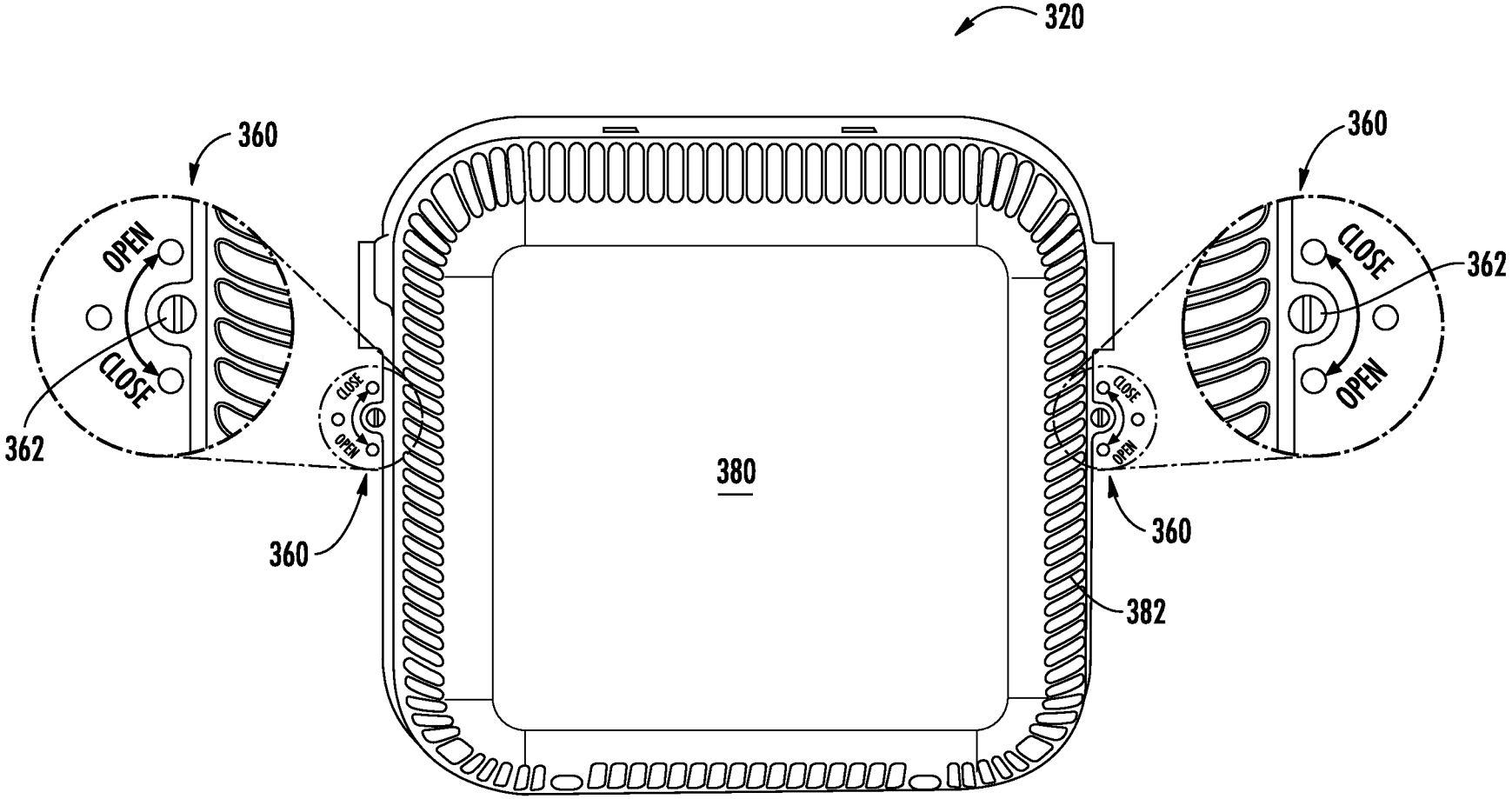
FIG. 17 is a bottom plan view of the antenna cover of the remote unit assembly in FIG. 16, including magnified bottom plan views of rotatable user-accessible actuation elements arranged along peripheral edges of the antenna cover, with the actuation elements configured to actuate retaining mechanisms.

FIG. 17 is a bottom plan view of the antenna cover 380 of the remote unit assembly according to the second embodiment, including magnified bottom plan views of rotatable user-accessible actuation elements 362 (e.g., including screw heads) of retention mechanisms 360 arranged along peripheral edges of the antenna cover 380. According to one embodiment, the retention mechanisms 360 can be secured to the support plate and can be accessible by removing a trim ring (shown in FIG. 18) disposed below the support plate peripheral to an electronic component received by the pivot arm 340. The antenna cover 380 includes openings or vents 382 around a lower lateral surface thereof to enable heat generated by at least one electronic component to be dissipated into an ambient environment.

Figure 18:
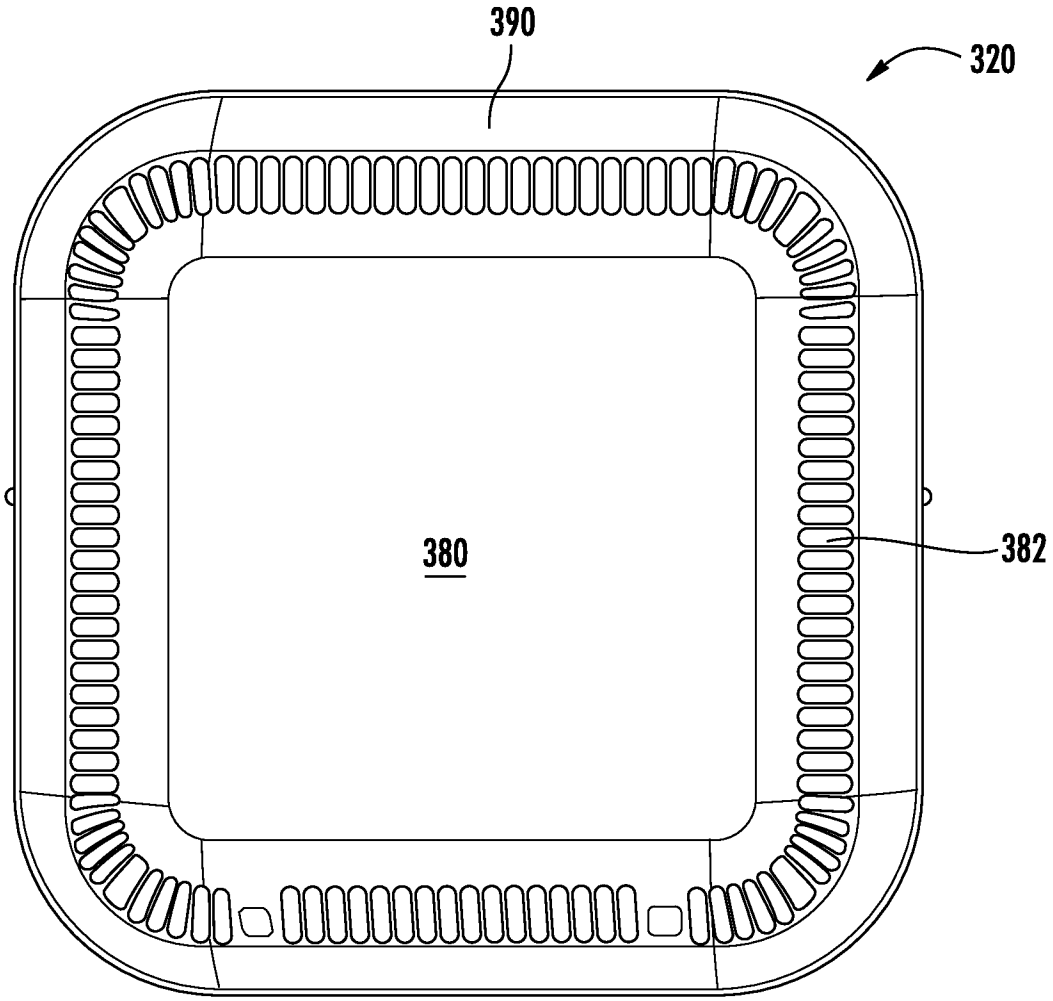
FIG. 18 is a bottom plan view of the antenna cover of the remote unit assembly in FIG. 17, with a trim ring arranged along a perimeter of the antenna cover.

FIG. 18 is a bottom plan view of the antenna cover 380 of the remote unit assembly 320 according to the second embodiment, with a trim ring 390 arranged along a perimeter of the antenna cover to cover the user-accessible actuation elements (shown in FIG. 17). As shown, the antenna cover 380 includes openings or vents 382 around a lower lateral surface thereof.

Figure 19:
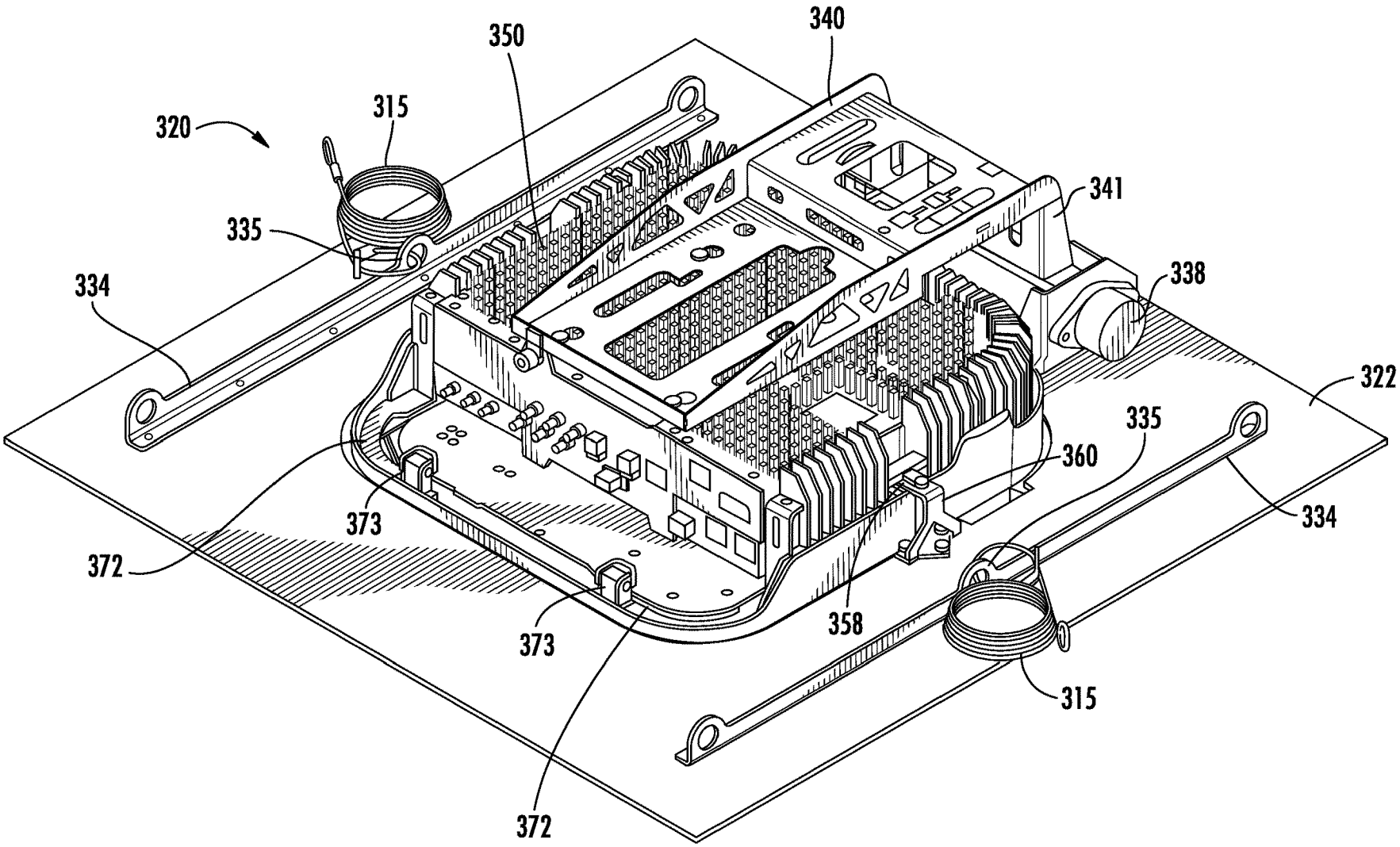
FIG. 19 is an upper perspective view of the remote unit assembly in FIG. 16 with the pivot arm and electronic components in the horizontal position, and with coiled support cables connected to support lugs arranged along the top surface of the support plate.

FIG. 19 is an upper perspective view of the remote unit assembly 320 according to the second embodiment with the pivot arm 340 and the at least one electronic component 350 in a horizontal position, and with coiled support cables 315 connected to support lugs 335 extending from rails 334 arranged along a top surface of the support plate 322. As shown, retention elements 360 are positioned with tabs thereof engaging recesses 358 provided along side surfaces of the electronic component 350 to retain the electronic component 350 and the pivot arm 340 in a horizontal position. Pivotal links 372 each having a curved shape are coupled between the antenna cover 380 and the electronic component 350 via hinge members 373 to permit the antenna cover 380 to rotate downward relative to the electronic component 350

Figure 20:
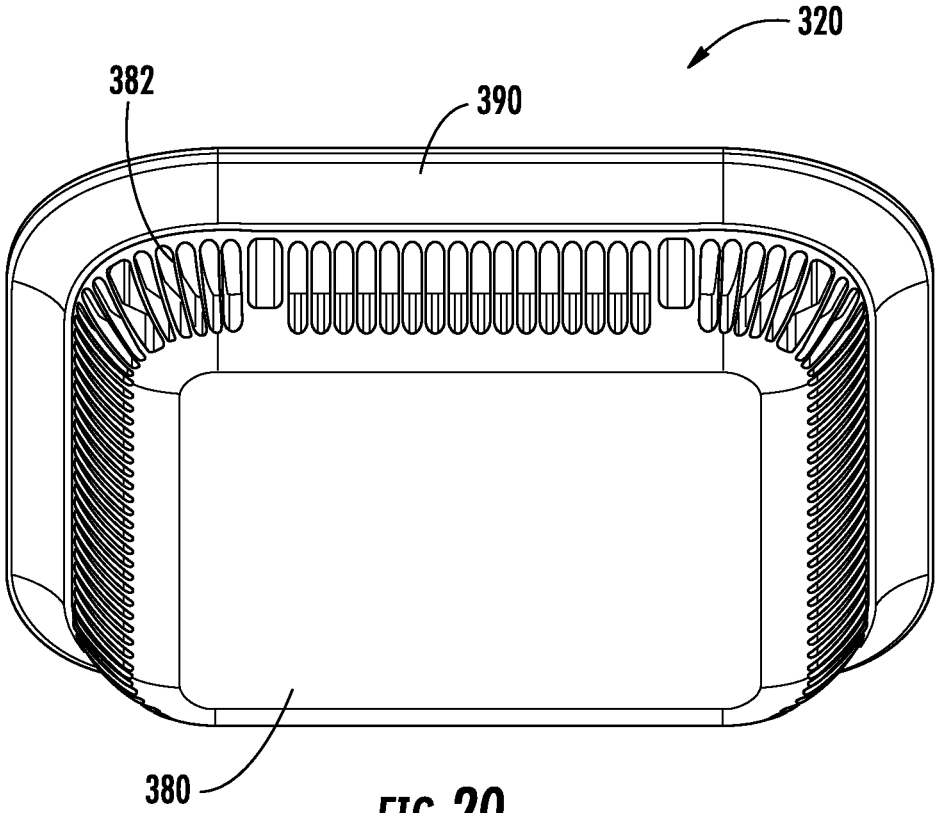
FIG. 20 is a lower perspective view of the antenna cover of the remote unit assembly in FIG. 19, with the trim ring arranged along the perimeter of the antenna cover.

FIG. 20 is a lower perspective view of the antenna cover 380 of the remote unit assembly 320 according to the second embodiment, with a trim ring 390 arranged along an upper perimeter of the antenna cover 380, and showing openings or vents 382 around a lower lateral surface of the antenna cover 380. As shown, the antenna cover 380 and trim ring 390 provide a finished, aesthetically pleasing appearance, while the remote unit assembly still facilitates easy access to any electronic components contained therein.

Figure 21:
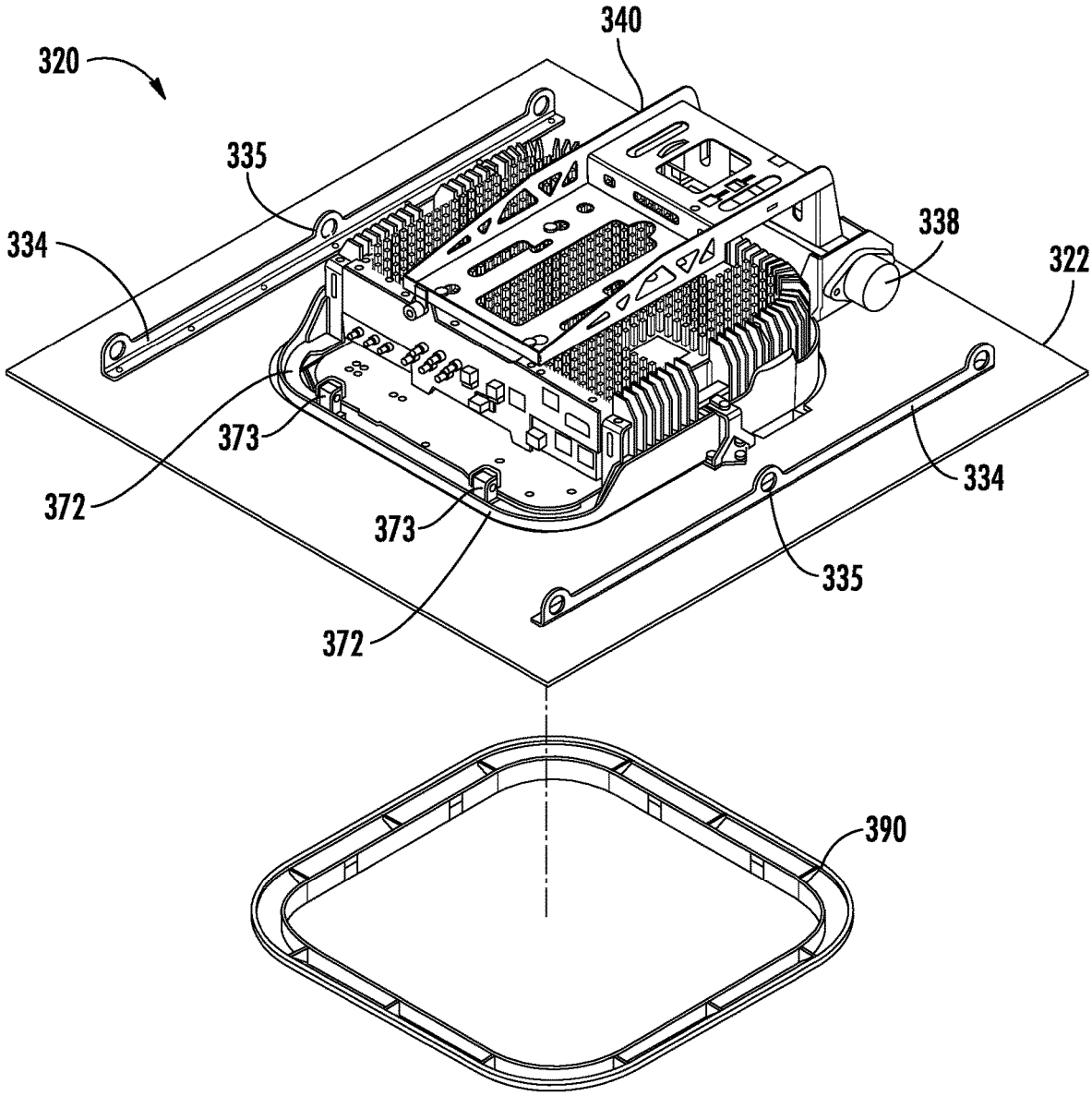
FIG. 21 is an upper perspective view of the remote unit assembly in FIG. 20 with the pivot arm and electronic components in the horizontal position, and showing the trim ring removed from and positioned generally below the remote unit assembly.

FIG. 21 is an upper perspective view of the remote unit assembly 320 according to the second embodiment with the pivot arm 340 and at least one electronic component 350 in a horizontal position, showing a trim ring 390 removed from and positioned generally below the remote unit assembly 320. The pivot arm 340 is coupled to the support plate 322 with a pivot 338. Rings or support lugs 335 are joined to peripheral rails 334, which are coupled to a top surface of the support plate 322. Pivotal links 372 and hinge members 373 provide pivotal coupling between the antenna cover 380 and the electronic component 350 to permit the antenna cover 380 to pivot downward relative to the electronic component 350.

Figure 22:
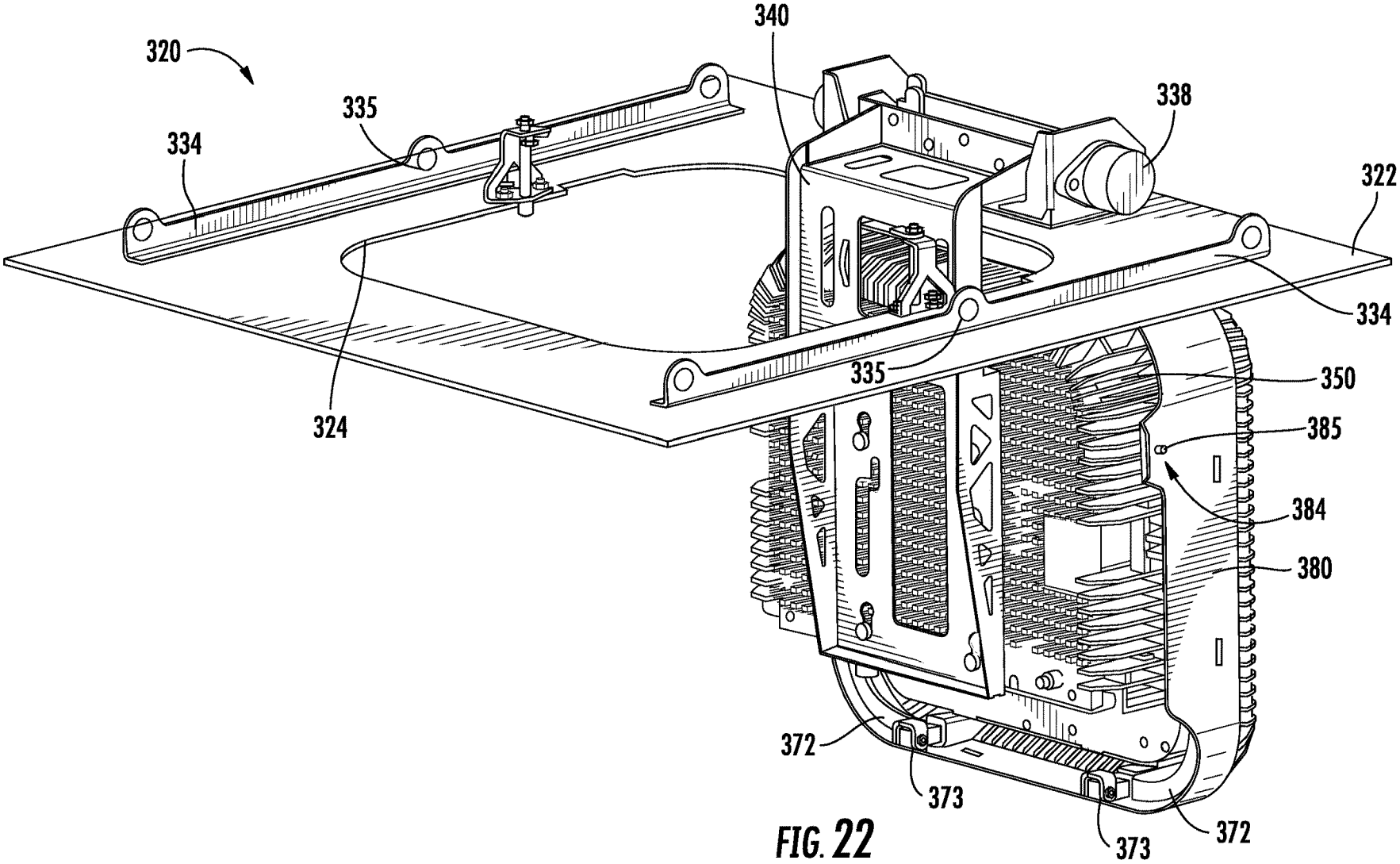
FIG. 22 is an upper front perspective view of the remote unit assembly in FIG. 21 with the pivot arm and electronic components (e.g., RXU and GEM modules) in the vertical position, and with the antenna cover in a closed position.
Figure 23:
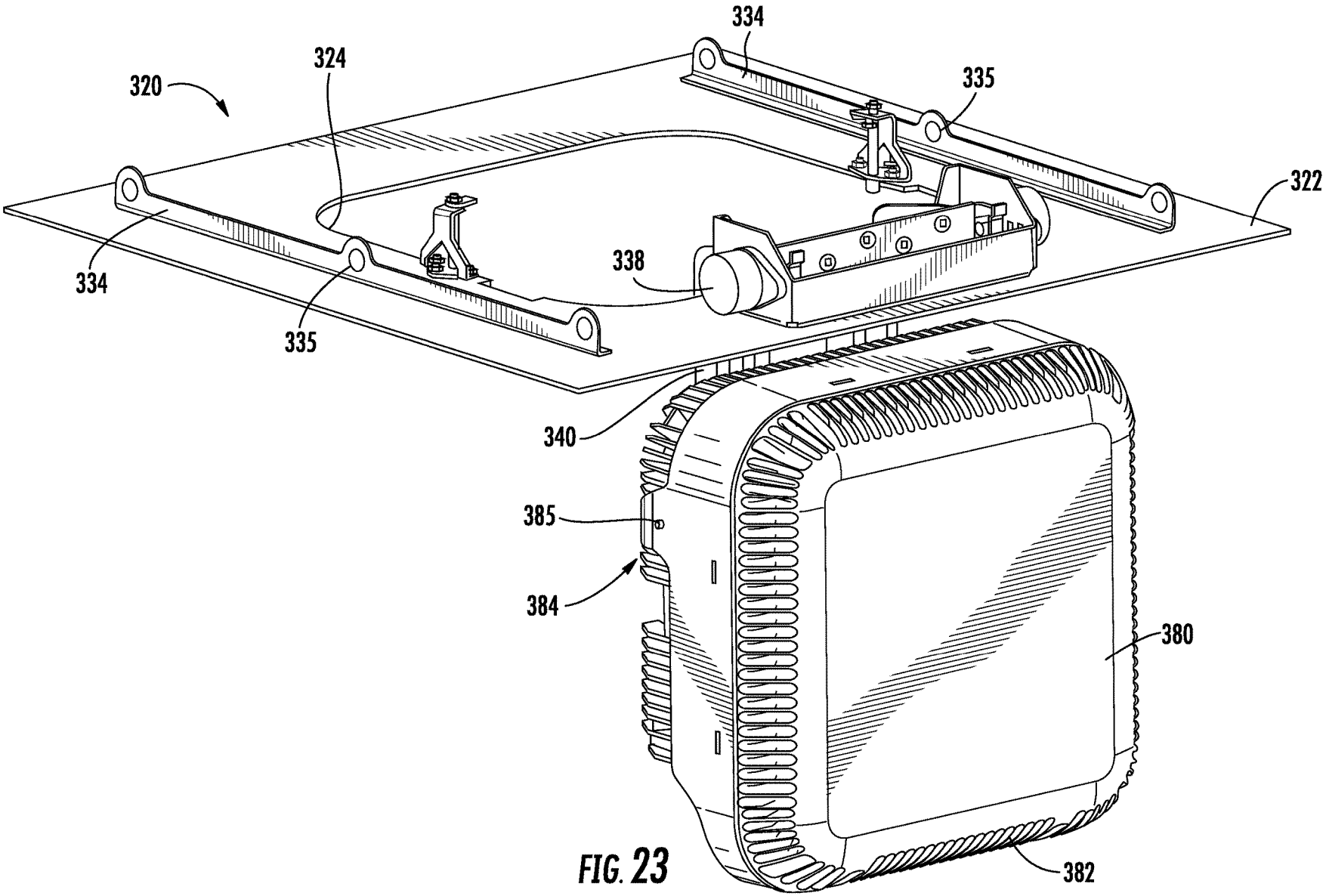
FIG. 23 is an upper rear perspective view of the remote unit assembly in FIG. 22 with the pivot arm and electronic components (e.g., RXU and GEM modules) in the vertical position, and with the antenna cover in the closed position.

FIGS. 22 and 23 provide upper front and upper rear perspective views, respectively, of the remote unit assembly 320 according to the second embodiment with the pivot arm 340 and the at least one electronic component 350 in a vertical position, and with the antenna cover 380 in a closed position. The pivot arm 340 is coupled to the support plate 322 via at least one pivot 338. The antenna cover 350 includes an upwardly extending ear portion 384 receiving a laterally extending cover retention/spring pin 385. The antenna cover 380 includes openings or vents 382 around a lower lateral surface thereof. Pivotal links 372 each having a curved shape are coupled between the antenna cover 380 and the electronic component 350 via hinge members 373 to permit the antenna cover 380 to rotate downward relative to the electronic component 350. Horizontal support rails 334 defining lugs 335 are arranged on either side of the aperture 324 along a top surface of the support plate 322.

Figure 24:
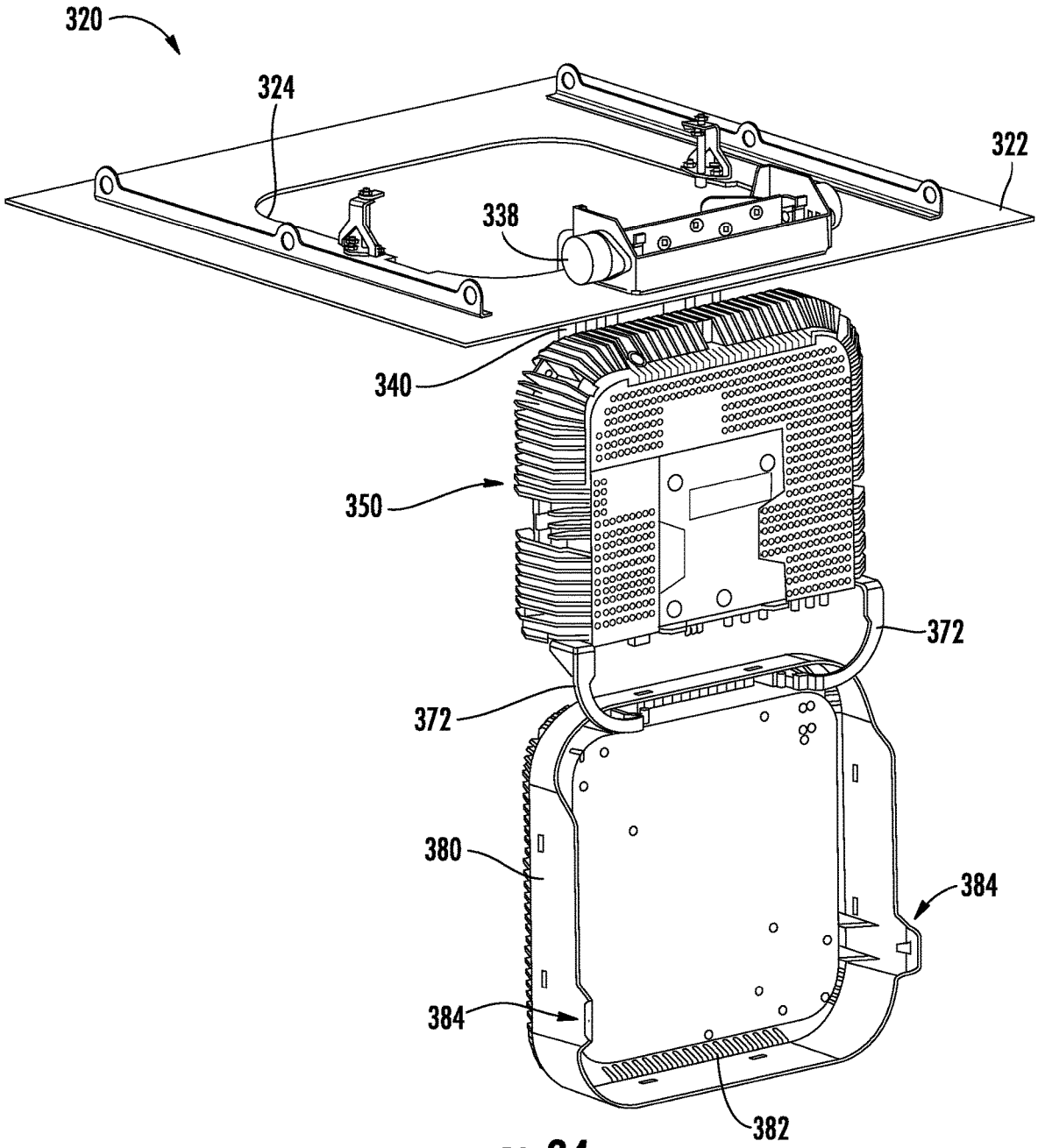
FIG. 24 is an upper rear perspective view of the remote unit assembly in FIG. 23 with the pivot arm and electronic components (e.g., RXU and GEM modules) in the vertical position, and with the antenna cover in an open position and hanging generally below the electronic components.
Figure 25:
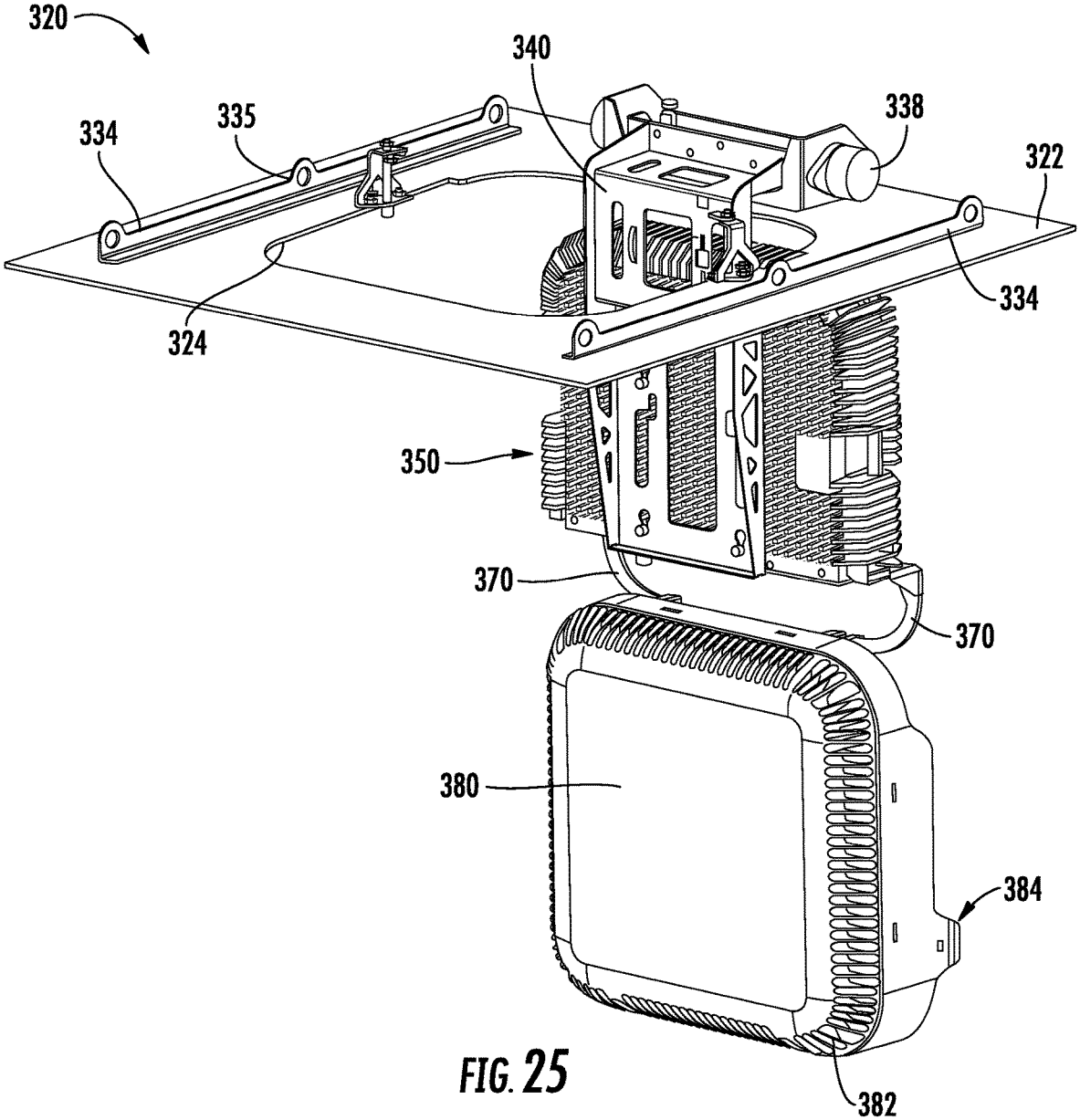
FIG. 25 is an upper front perspective view of the remote unit assembly in FIG. 24 with the pivot arm and electronic components (e.g., RXU and GEM modules) in the vertical position, and with the antenna cover in the open position and hanging generally below the electronic components.

FIGS. 24 and 25 are upper front and upper rear perspective views, respectively, of the remote unit assembly according to the second embodiment, with the pivot arm 340 and at least one electronic component 350 in a vertical position, and with the antenna cover 380 in an open position and hanging generally below the electronic component 350. The antenna cover 380 includes ear portions 384 each arranged to receive a laterally extending cover retention/spring pin. Pivotal links 372 each having a curved shape are coupled between the antenna cover 380 and the electronic component 350 via hinge members 373 to permit the antenna cover 380 to rotate downward relative to the electronic component 350.

Figure 26:
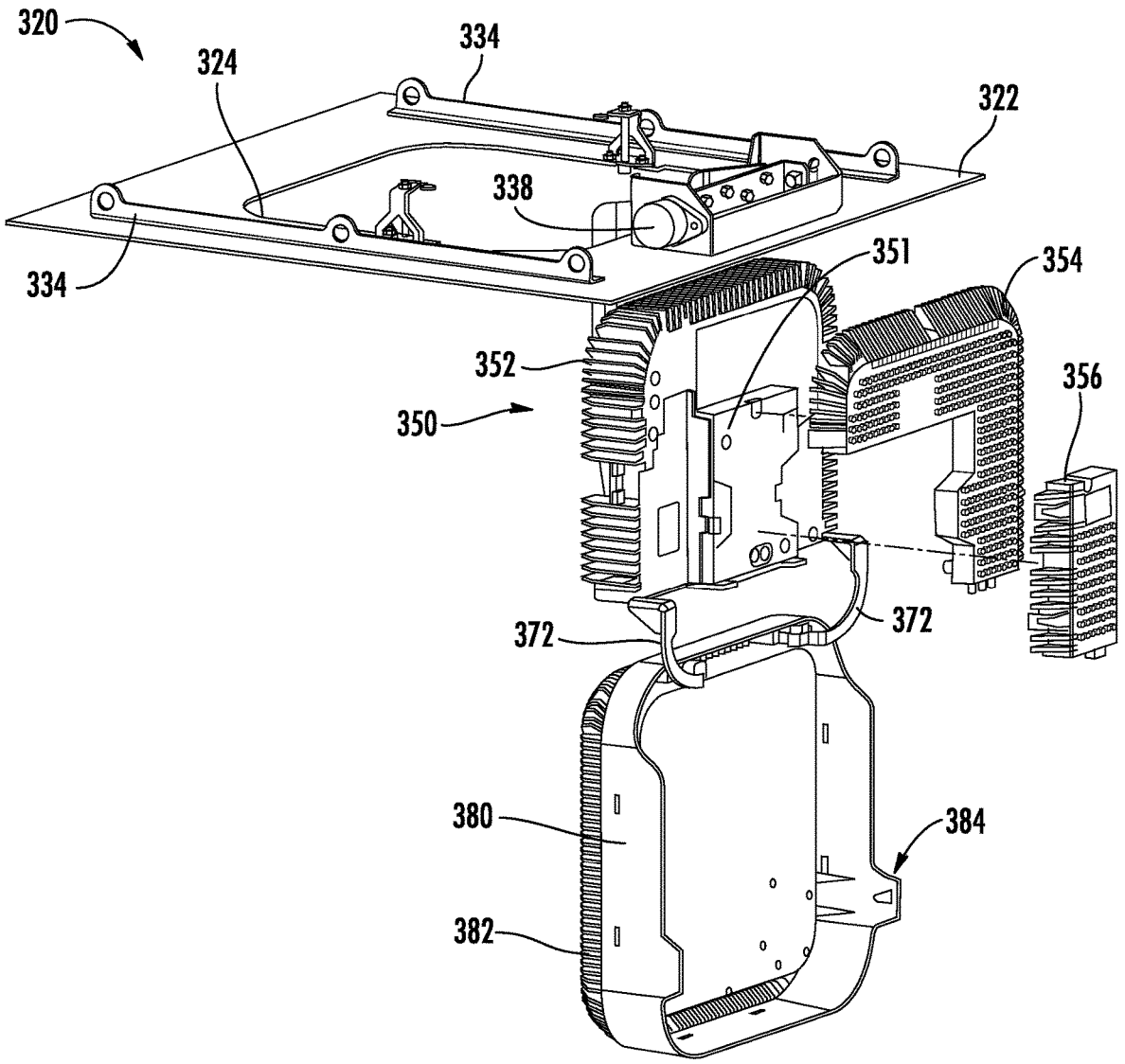
FIG. 26 is an upper rear perspective view of the remote unit assembly in FIG. 25 with the pivot arm and electronic components in the vertical position, with the antenna cover in the open position and hanging generally below the electronic components, and with multiple electronic subcomponents removed from the pivot arm.

FIG. 26 is an upper rear perspective view of the remote unit assembly 320 according to the second embodiment, with the pivot arm 340 and at least one electronic component 350 in a vertical position. As shown, the antenna cover 380 is in an open position and hanging generally below the electronic component 350. Pivotal links 372 each having a curved shape are coupled between the antenna cover 380 and the electronic component 350 via hinge members 373 to permit the antenna cover 380 to rotate downward relative to the electronic component 350. The electronic component 350 further includes a heat sink 352 that may include multiple fins. Electronic subcomponents 354, 356 are illustrated as disengaged from a mount 351 and the remainder of the electronic component 350. In one example, the electronic subcomponents 354, 356 may include a Remote Extender Unit (RXU) module 354 and a Gigabit Ethernet Module (GEM) 356. By pivoting the pivot arm 340 and electronic component 350 downward, and opening the antenna cover 380 (e.g., by depressing pins received by ear portions 384 of the antenna cover), easy access to the electronic components 350 is provided (e.g., for servicing or maintenance thereof) without requiring the entire remote antenna unit 320 to be uninstalled.

According to another aspect, the remote unit assembly is configured to conform to standardized ceiling tiles. For example, a conventional 24 inch (61 cm) drop ceiling can accommodate the ceiling mounting arrangement of a remote unit. An exemplary aperture-defining support plate of a remote unit assembly that is conforms in size and shape to a standardized ceiling tile is further devoid of a frame and any other interfering elements at peripheral edges of the support plate, to permit the support plate to reside within a conventional drop ceiling grid without modification thereof.

Remote unit assemblies for distributed communications systems disclosed herein include a support member arranged to be mounted in a ceiling (preferably in or on a drop ceiling grid positioned below a main or structural ceiling), and a pivoting structure such as a pivot arm that is configured to receive one or more electronic components to permit the electronic components to pivot between a substantially horizontal position suitable for operation and a substantially vertical position suitable for maintenance to facilitate access to the electronic components. When an electronic component is in the substantially horizontal position, the entire pivot arm is arranged above the drop ceiling grid, preferably with an electronic component received below the pivot arm. In one implementation, a remote unit assembly includes a slow release mechanism configured to reduce a rate of pivotal motion of the pivot arm and the electronic components relative to an uncontrolled rate of pivotal motion motivated by gravity, thereby preventing the pivot arm and electronic components from pivoting at a high rate of speed and possibly injuring a user (e.g., maintenance personnel). In one implementation, at least one retention mechanism associated with the support member is configured to selectively engage the electronic component (e.g., along at least one side surface thereof) to retain the electronic component in the substantially horizontal position, wherein the at least one retention mechanism includes a user-accessible actuation element accessible at or along a lower surface of the support member, thereby permitting the user to actuate the at least one retention mechanism from an environment below the remote unit assembly.

An exemplary support member for use with a remote unit assembly for a distributed communications system described herein includes a plate or plate-like member configured to be positioned in the drop ceiling grid in place of a conventional ceiling tile. An exemplary support plate is sized and shaped to replace a conventional ceiling tile, and is devoid of a frame along peripheral edges thereof, to permit the support plate to reside within a conventional drop ceiling grid without modification to the ceiling grid. Such a plate may include metallic material such as sheet metal, optionally supplemented with one or more stiffened portions such as rail portions inboard from lateral edges of the plate, wherein any stiffened portions may be arranged along an upper surface of the support member to promote a clean aesthetic of a lower surface of the plate when viewed from below. The support member may additionally or alternatively include one or more peripheral supports connectable by one or more rails and/or connected to a support frame, preferably inboard from lateral edges of the plate to avoid any need for modification of a conventional drop ceiling grid. In an exemplary embodiment, a support plate has a length and a width each falling into a range of two feet+/−four inches (i.e., 61 cm+/−10 cm), and conforms in lateral size and shape to a conventional ceiling tile.

A pivot arm, optionally included as part of a lift bracket of the remote unit assembly, is preferably provided along an upper surface of a support member, such as a support plate. The pivot arm is configured to receive an electronic component, preferably below the pivot arm, and to permit the electronic component to pivot between the substantially horizontal position and the substantially vertical position. The pivot arm is preferably arranged to rotate about one or more pivots, such as may be embodied in a one or more rotary members and/or hinges. The support member preferably includes an aperture or opening through which a portion of a pivot arm may extend in certain positional states. When the pivot arm is in the substantially horizontal position, it is located above the support member without extending through the aperture of the support member; however, at least a portion of one or more electronic components supported by the pivot arm preferably extends through the aperture, such that one portion of the electronic component(s) may be positioned above the support member, and another portion of the electronic component(s) may be positioned below the support member. When the pivot arm is pivoted downward from the substantially horizontal position, a portion of the pivot arm bearing one or more electronic components is arranged to travel through the aperture to the substantially vertical position in which the electronic component(s) may be accessed for maintenance or installation. Preferably, the slow release mechanism is associated with the pivot arm and configured to reduce the rate of pivotal motion of the pivot arm and the electronic component between the substantially horizontal position and the substantially vertical position. An example of the slow release mechanism that may be used is a rotary damper; however, other slow release mechanisms such as brake mechanisms, linear dampers, or the like could be used.

At least one retention mechanism associated with the support member is preferably provided along the upper surface of the support member and is configured to selectively engage the electronic component (e.g., along side surfaces thereof) to retain the electronic component in the substantially horizontal position. To permit the user to operate the retention mechanism when the electronic component is in the substantially horizontal position, the user-accessible actuation element is arranged at or along the lower surface of the support member. An example of a suitable retention mechanism includes a vertically extending shaft including one or more laterally extending tabs positioned above the support member and arranged to engage a surface of an electronic component, with a rotatable screw or knob positioned along the lower surface of the support member to enable selective rotation of the vertically extending shaft and associated tabs.

The support member disclosed herein preferably includes one or more cable receiving members such as lugs or rings to receive one or more support cables suspended from a structural ceiling arranged above the drop ceiling grid. Such support cables are preferably provided as a safety feature to ensure that the remote unit assembly cannot fall on the user positioned below the drop ceiling even if the drop ceiling is rendered incapable of supporting the remote unit assembly.

An exemplary remote unit assembly for a distributed communications system includes at least one electronic component mounted to the pivot arm, with an antenna cover arranged generally below the electronic component to be positioned at or below the support plate and the drop ceiling grid when the electronic component is in the substantially horizontal position. A portion of the electronic component is preferably arranged below an aperture defined in the support plate when the electronic component is in the substantially horizontal position. The antenna cover serves to cover and protect at least one electronic component, and preferably includes ventilation openings arranged proximate to the portion of the electronic component arranged below the aperture to allow heat generated by at least one electronic component to be dissipated into an ambient environment. Positioning of a portion of an electronic component below a suspended ceiling with ventilation openings of the antenna cover arranged proximate to the portion of the electronic component facilitates dissipation of heat generated by the electronic component in an ambient environment below the drop ceiling, thereby avoiding potential overheating issues if the entire electronic component were positioned in an enclosed, unventilated space between a drop ceiling and a structural ceiling. An exemplary antenna cover further includes an antenna operatively coupled with at least one electronic component to assist in reception and/or transmission of communications signals.

The exemplary antenna cover includes at least one pivotal link arranged between the antenna cover and the electronic component to permit pivotal movement between the antenna cover and the electronic component, such as to permit the antenna cover to pivot between (i) a closed position proximate to the electronic component and (ii) an open position hanging generally below the electronic component when the electronic component is in the substantially vertical position. Multiple pivotal links may be provided. An exemplary pivotal link further conducts at least one electrical signal between an antenna portion of the antenna cover (e.g., an antenna embedded or otherwise integrated in the antenna cover) and the electronic component.

In order to permit the user to control closure of the antenna cover relative to at least one electronic component, at least one engagement member is configured to be operated by the user to selectively engage the antenna cover in the closed position proximate to the electronic component. In this manner, the antenna cover may be disengaged from the electronic component when necessary to service or maintain the electronic component and may be re-engaged to the electronic component to ready the remote unit assembly for operation. The ability to pivot the antenna cover away from the electronic component enables servicing of top and bottom surfaces of an electronic component in a service position without requiring removal of the electronic component from the remote antennal unit. Servicing of the electronic component may include, for example, adding or removing an electronic subcomponent (e.g., a module) relative to the electronic component.

A remote unit assembly for a distributed communications system disclosed herein may be accessed by pivoting the pivot arm and the electronic component received by the pivot arm from the substantially horizontal position to the substantially vertical position to permit the electronic component to be accessed by the user. When the support member of the remote unit assembly includes an aperture, the pivotal movement of the pivot arm causes at least a portion of the pivot arm to travel through the aperture.

Figure 27:
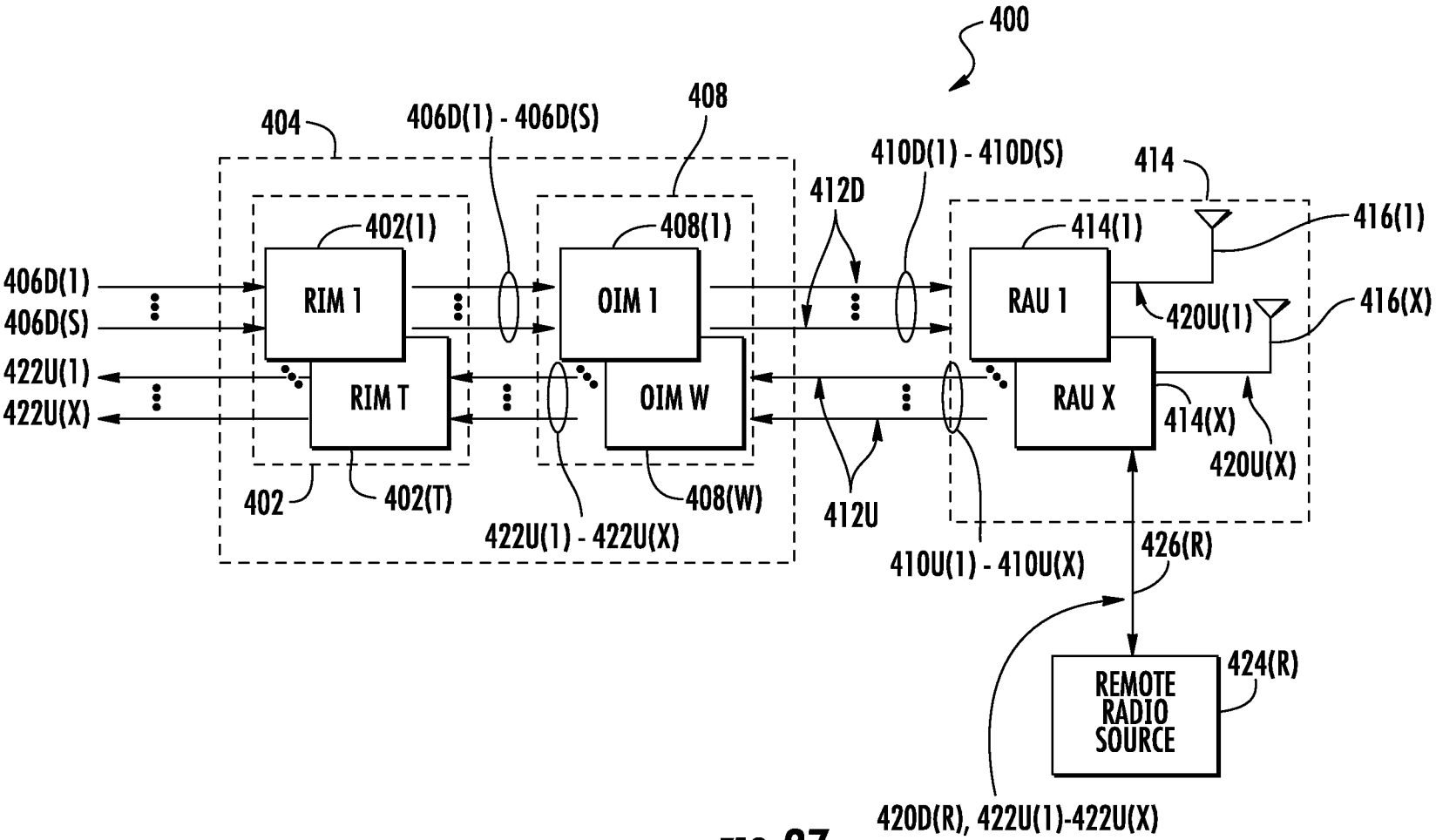
FIG. 27 is a schematic diagram of an exemplary DCS provided in the form of an optical fiber-based distributed antenna system (DAS) that includes a central unit configured to distribute communications signals over optical fiber to a plurality of remote units, wherein unlicensed communications signal paths in the plurality of remote units are configured to be disabled or disconnected to disable distribution of unlicensed communications signals based on monitored communications signal activity in unlicensed spectrum on the unlicensed communications signal path(s) in the plurality of remote units.

FIG. 27 is a schematic diagram of exemplary distributed antenna system (DAS) 400 that may include or may be arranged to cooperate with one or more remote antenna units described herein. For example, an exemplary remote antenna unit includes a support member (e.g., a support plate) configured to be mounted in a drop ceiling grid, and a pivot arm supported by the support member and configured to receive an electronic component to permit the electronic component to pivot between a substantially horizontal position and a substantially vertical position, wherein various embodiments include features that enhance user safety, facilitate efficient installation, and/or promote enhanced serviceability of electronic components. The DAS 400 in this example is an optical fiber-based DAS. The DAS 400 in this example is comprised of three (3) main components. One or more radio interfaces provided in the form of radio interface modules (RIMs) 402(1)-402(T) are provided in a central unit 404 to receive and process downlink electrical communications signals 406D(1)-406D(S) prior to optical conversion into downlink optical communications signals. The downlink electrical communications signals 406D(1)-406D(S) may be received from a base station (not shown) as an example. The RIMs 402(1)-402(T) provide both downlink and uplink interfaces for signal processing. The notations "1-S" and "1-T" indicate that any number of the referenced component, 1-S and 1-T, respectively, may be provided.

With continuing reference to FIG. 27, the central unit 404 is configured to accept the plurality of RIMs 402(1)-402(T) as modular components that can easily be installed and removed or replaced in the central unit 404. In one embodiment, the central unit 404 is configured to support up to twelve (12) RIMs 402(1)-402(12). Each RIM 402(1)-402(T) can be designed to support a particular type of radio source or range of radio sources (i.e., frequencies) to provide flexibility in configuring the central unit 404 and the multi-frequency DAS 400 to support the desired radio sources. For example, one RIM 402 may be configured to support the Personal Communication Services (PCS) radio band. Another RIM 402 may be configured to support the 700 MHz radio band. In this example, by inclusion of these RIMs 402, the central unit 404 could be configured to support and distribute unlicensed and/or licensed communications signals. Licensed communications signals could include both PCS and LTE 700 radio bands, as examples. Unlicensed communications signals and could include WiFi signals as an example. RIMs 402 may be provided in the central unit 404 that support any licensed frequency bands desired, including but not limited to the US Cellular band, Personal Communication Services (PCS) band, Advanced Wireless Services (AWS) band, 700 MHz band, Global System for Mobile communications (GSM) 900, GSM 1800, and Universal Mobile Telecommunication System (UMTS). The RIMs 402(1)-402(T) may also be provided in the central unit 404 that support any wireless technologies desired, including but not limited to Code Division Multiple Access (CDMA), CDMA200, 1×RTT, Evolution-Data Only (EV-DO), UMTS, High-speed Packet Access (HSPA), GSM, General Packet Radio Services (GPRS), Enhanced Data GSM Environment (EDGE), Time Division Multiple Access (TDMA), Long Term Evolution (LTE), iDEN, and Cellular Digital Packet Data (CDPD).

The RIMs 402(1)-402(T) may be provided in the central unit 404 that support any frequencies desired, including but not limited to licensed US FCC and Industry Canada frequencies 824-849 MHz on uplink and 869-894 MHz on downlink, US FCC and Industry Canada frequencies 1850-1915 MHz on uplink and 1930-1995 MHz on downlink, US FCC and Industry Canada frequencies 1710-1755 MHz on uplink and 2110-2155 MHz on downlink, US FCC frequencies 698-716 MHz and 776-787 MHz on uplink and 728-746 MHz on downlink, EU R & TTE frequencies 880-915 MHz on uplink and 925-960 MHz on downlink, EU R & TTE frequencies 1710-1785 MHz on uplink and 1805-1880 MHz on downlink, EU R & TTE frequencies 1920-1980 MHz on uplink and 2110-2170 MHz on downlink, US FCC frequencies 806-824 MHz on uplink and 851-869 MHz on downlink, US FCC frequencies 896-901 MHz on uplink and 929-941 MHz on downlink, US FCC frequencies 793-805

MHz on uplink and 763-775 MHz on downlink, and US FCC frequencies 2495-2690 MHz on uplink and downlink.

With continuing reference to FIG. 27, the downlink electrical communications signals 406D(1)-406D(S) are provided to a plurality of optical interfaces provided in the form of optical interface modules (OIMs) 408(1)-408(W) in this embodiment to convert the unlicensed and/or licensed downlink electrical communications signals 406D(1)-406D(S) ("downlink electrical communications signals 406D(1)-406D(S)") into downlink optical communications signals 410D(1)-410D(S). The notation "1-W" indicates that any number of the referenced component 1-W may be provided. The OIMs 408 may be configured to provide one or more optical interface components (OICs) that contain optical-to-electrical (O-E) and electrical-to-optical (E-O) converters, as will be described in more detail below. The OIMs 408 support the radio bands that can be provided by the RIMs 402.

The OIMs 408(1)-408(W) each include E-O converters to convert the downlink electrical communications signals 406D(1)-406D(S) into the downlink optical communications signals 410D(1)-410D(S). The downlink optical communications signals 410D(1)-410D(S) are communicated over downlink optical fiber communications medium 412D to a plurality of remote units provided in the form of remote antenna units 414(1)-414(X). The notation "1-X" indicates that any number of the referenced component 1-X may be provided. O-E converters provided in the remote antenna units 414(1)-414(X) convert the downlink optical communications signals 410D(1)-410D(S) back into the downlink electrical communications signals 406D(1)-406D(S), which are provided to antennas 416(1)-416(X) in the remote antenna units 414(1)-414(X) to user equipment (not shown) in the reception range of the antennas 416(1)-416(X).

E-O converters are also provided in the remote antenna units 414(1)-414(X) to convert licensed and/or unlicensed uplink electrical communications signals 420U(1)-420U(X) ("uplink electrical communications signals 420U(1)-420U(X)") received from user equipment (not shown) through the antennas 416(1)-416(X) into uplink optical communications signals 410U(1)-410U(S). The remote antenna units 414(1)-414(X) communicate the uplink optical communications signals 410U(1)-410U(S) over an uplink optical fiber communications medium 412U to the OIMs 408(1)-408(W) in a central unit 404. The OIMs 408(1)-408(W) include O-E converters that convert the received uplink optical communications signals 410U(1)-410U(S) into uplink electrical communications signals 422U(1)-422U(X), which are processed by the RIMs 402(1)-402(T) and provided as uplink electrical communications signals 422U(1)-422U(X). The central unit 404 may provide the uplink electrical communications signals 422U(1)-422U(X) to a source transceiver such as a base station or other communications system.

Note that the downlink optical fiber communications medium 412D and uplink optical fiber communications medium 412U connected to each remote antenna unit 414(1)-414(X) may be a common optical fiber communications medium wherein, for example, wave division multiplexing (WDM) may be employed to provide the downlink optical communications signals 410D(1)-410D(S) and the uplink optical communications signals 410U(1)-410U(S) on the same optical fiber communications medium.

With continuing reference to FIG. 27, the remote antenna unit 414(X) is a radio source remote antenna unit. The remote antenna unit 414(X) is directly communicatively coupled to a remote radio source 424(R) through a direct communicative coupling 426(R). The radio source remote antenna unit 414(X) is configured to receive remote downlink communications signals 420D(R) from the remote radio source 424(R) to be distributed to one or more of other remote antenna units 414(1)-414(X−1). In this example, the radio source remote antenna unit 414(X) distributes the received remote downlink communications signals 420D(R) to the central unit 404 to then be distributed to one or more other remote antenna units 414(1)-414(X−1). However, the radio source remote antenna unit 414(X) could also be configured to distribute the received remote downlink communications signals 420D(R) directly to one or more other remote antenna units 414(1)-414(X−1) in a daisy-chain configuration, if the remote antenna units 414(1)-414(X) in the DAS 400 were configured in a daisy-chain configuration. All of the exemplary discussion above with regard to radio source remote units, remote radio sources, and DCSs can be applied to the example DAS 400 in FIG. 27.

Figure 28:
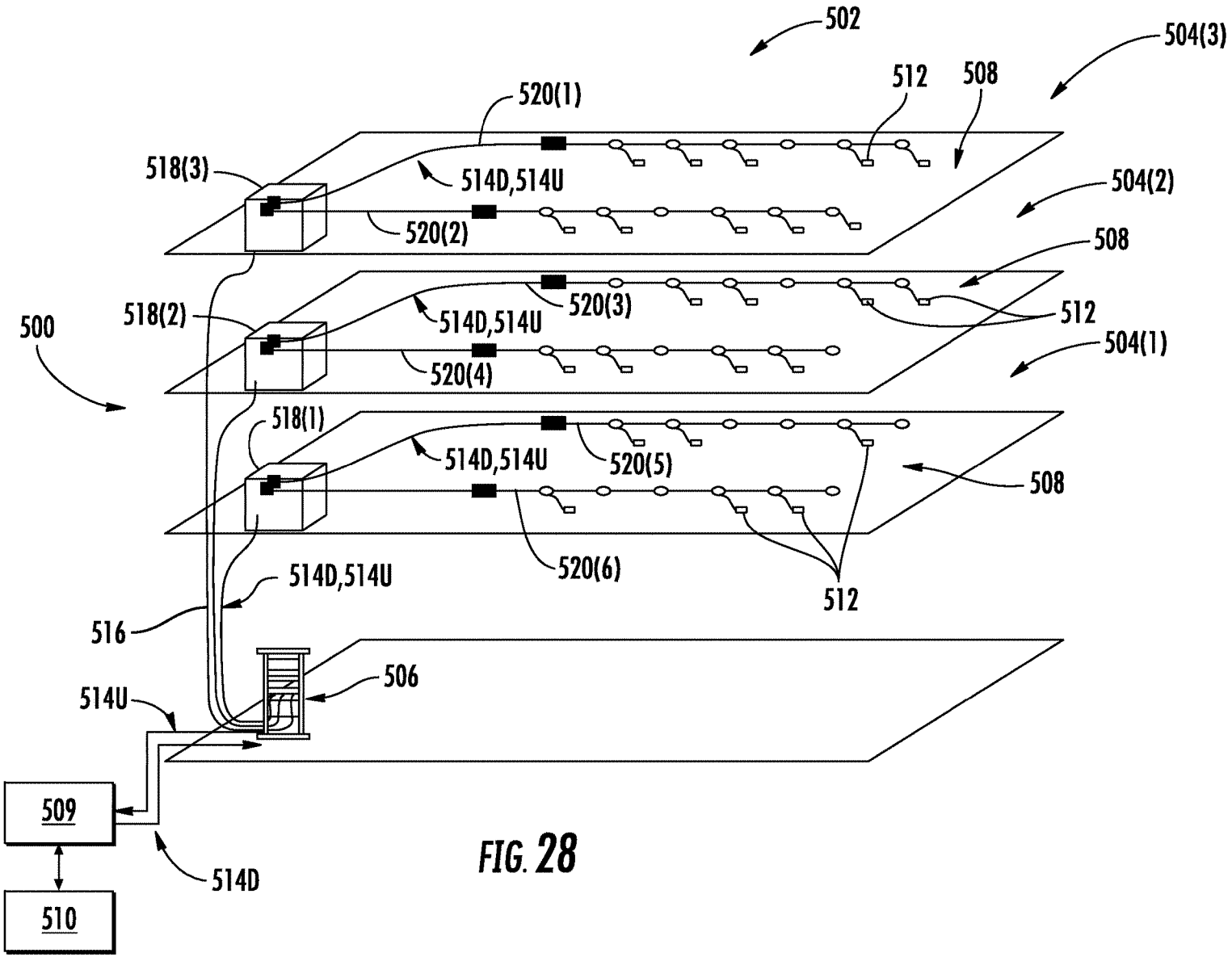
FIG. 28 is a partially schematic cut-away diagram of an exemplary building infrastructure in which a DCS can be provided, wherein unlicensed communications signal paths in the plurality of remote units are configured to be disabled or disconnected to disable distribution of unlicensed communications signals based on monitored communications signal activity in unlicensed spectrum on the unlicensed communications signal path(s) in the plurality of remote units.

FIG. 28 is a partially schematic cut-away diagram of a building infrastructure 500 employing a DAS 502 provided in an indoor environment and configured to evaluate performance of remote units on a per remote unit basis, as described above. The building infrastructure 500 in this embodiment includes a first (ground) floor 504(1), a second floor 504(2), and a third floor 504(3). The floors 504(1)-504(3) are serviced by the central unit 506 to provide the antenna coverage areas 508 in the building infrastructure 500. The central unit 506 is communicatively coupled to a base station 509 to receive downlink communications signals 514D from the base station 509. The base station 509 may be coupled to an operational and support system (OSS) 510 to receive data about the performance of remote antenna units 512 in the DAS 502 on a per remote unit basis for determining DAS optimizations. The central unit 506 is communicatively coupled to the remote antenna units 512 to receive uplink communications signals 514U from the remote antenna units 512, similar to as previously discussed above for other DASs. The downlink and uplink communications signals 514D, 514U communicated between the central unit 506 and the remote antenna units 512 are carried over a riser cable 516 in this example. The riser cable 516 may be routed through interconnect units (ICUs) 518(1)-518(3) dedicated to each floor 504(1)-504(3) that route the downlink and uplink communications signals 514D, 514U to the remote antenna units 512 and also provide power to the remote antenna units 512 via array cables 520(1)-520(6).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred.

It is also noted that the operational steps described in any of the exemplary embodiments herein are described to provide examples and discussion. The operations described may be performed in numerous different sequences other than the illustrated sequences. Furthermore, operations described in a single operational step may actually be performed in a number of different steps. Additionally, one or more operational steps discussed in the exemplary embodiments may be combined. Those of skill in the art will also understand that information and signals may be represented using any of a variety of technologies and techniques. For example, data, instructions, commands, information, signals, bits, symbols, and chips, that may be referenced throughout the above description, may be represented by voltages, currents, electromagnetic waves, magnetic fields, or particles, optical fields or particles, or any combination thereof.

It will be apparent to those skilled in the art that various modifications and variations can be made without departing from the spirit or scope of the invention. Since modifications combinations, sub-combinations, and variations of the disclosed embodiments incorporating the spirit and substance of the invention may occur to persons skilled in the art, the invention should be construed to include everything within the scope of the appended claims and their equivalents.

What is claimed is:

1. A remote unit assembly for a distributed communication system, the remote unit assembly comprising:

a support member configured to be mounted in a drop ceiling grid;

a pivot arm supported by the support member, the pivot arm being configured to receive an electronic component and to permit the electronic component to pivot between a substantially horizontal position and a substantially vertical position; and a slow release mechanism configured to reduce a rate of pivotal motion of the pivot arm and the electronic component between the substantially horizontal position and the substantially vertical position, relative to an uncontrolled rate of pivotal motion motivated by gravity.

2. The remote unit assembly of claim 1, wherein the support member comprises a support plate defining an aperture, wherein at least a portion of the pivot arm is configured to travel through the aperture when the electronic component pivots between the substantially horizontal position and the substantially vertical position.

3. The remote unit assembly of claim 2, further comprising a plurality of cable receiving members associated with the support member, wherein each cable receiving member of the plurality of cable receiving members is configured to receive a support cable suspended from a ceiling structure arranged above the drop ceiling grid.

4. The remote unit assembly of claim 1, further comprising at least one retention mechanism associated with the support member and configured to selectively retain the electronic component in the substantially horizontal position, wherein the at least one retention mechanism includes a user-accessible actuation element at or along a lower surface of the support member.

5. The remote unit assembly of claim 1, further comprising the electronic component mounted to the pivot arm, and an antenna cover arranged below the electronic component, wherein at least a portion of the antenna cover is configured to be positioned below the drop ceiling grid when the electronic component is in the substantially horizontal position.

6. The remote unit assembly of claim 5, further comprising at least one pivotal link configured to permit pivotal movement between the antenna cover and the electronic component, and to permit the antenna cover to pivot between (i) a closed position proximate to the electronic component and (ii) an open position hanging generally below the electronic component when the electronic component is in the substantially vertical position.

7. The remote unit assembly of claim 6, further comprising at least one engagement member configured to be operated by a user to selectively engage the antenna cover in the closed position proximate to the electronic component.

8. The remote unit assembly of claim 1, wherein when the electronic component is in the substantially horizontal position, the pivot arm is arranged above the drop ceiling grid, and at least a portion of the electronic component is arranged below the drop ceiling grid.

9. A remote unit assembly for a distributed communication system, the remote unit assembly comprising:

a support plate configured to be mounted in a drop ceiling grid and defining an aperture;

an electronic component;

a pivot arm supported above the support plate, the pivot arm being configured to receive the electronic component below the pivot arm and to permit the electronic component to pivot between a substantially horizontal position and a substantially vertical position, wherein when the electronic component is in the substantially horizontal position, the pivot arm is arranged above the drop ceiling grid, and wherein a portion of the pivot arm is configured to travel through the aperture when the electronic component pivots between the substantially horizontal position and the substantially vertical position; and at least one retention mechanism associated with the support plate and configured to selectively engage the electronic component to retain the electronic component in the substantially horizontal position, wherein the at least one retention mechanism includes a user-accessible actuation element accessible at or along a lower surface of the support plate.

10. The remote unit assembly of claim 9, further comprising a slow release mechanism configured to reduce a rate of pivotal motion of the pivot arm and the electronic component between the substantially horizontal position and the substantially vertical position, relative to an uncontrolled rate of pivotal motion motivated by gravity.

11. The remote unit assembly of claim 9, further comprising a plurality of cable receiving members associated with the support plate, wherein each cable receiving member of the plurality of cable receiving members is configured to receive a support cable suspended from a ceiling structure arranged above the drop ceiling grid.

12. The remote unit assembly of claim 9, further comprising an antenna cover arranged below the electronic component, wherein at least a portion of the antenna cover is configured to be positioned below the drop ceiling grid when the electronic component is in the substantially horizontal position.

13. The remote unit assembly of claim 12, further comprising at least one pivotal link configured to permit pivotal movement between the antenna cover and the electronic component, and to permit the antenna cover to pivot between (i) a closed position proximate to the electronic component and (ii) an open position hanging generally below the electronic component when the electronic component is in the substantially vertical position.

14. The remote unit assembly of claim 13, further comprising at least one engagement member configured to be operated by a user to selectively engage the antenna cover in the closed position proximate to the electronic component.

15. The remote unit assembly of claim 9, wherein the support plate is sized and shaped to replace a conventional ceiling tile, and is devoid of a frame along peripheral edges thereof.

16. A method of accessing a remote unit assembly for a distributed communication system, the remote unit assembly comprising an electronic component, a support plate configured to be mounted in a drop ceiling grid, a pivot arm supported above the support plate and being configured to receive the electronic component below the pivot arm and to permit the electronic component to pivot between a substantially horizontal position and a substantially vertical position, the method comprising:

pivoting the pivot arm and the electronic component from the substantially horizontal position to the substantially vertical position, wherein said pivoting causes a portion of the pivot arm to travel through an aperture defined in the support plate; and accessing the electronic component.

17. The method of claim 16, wherein a portion of the electronic component is arranged below the aperture when the electronic component is in the substantially horizontal position, and the remote unit assembly comprises an antenna cover including ventilation openings arranged proximate to the portion of the electronic component.

18. The method of claim 17, wherein the remote unit assembly comprises the antenna cover arranged below the support plate, and the method further comprises disengaging the antenna cover from the electronic component.

19. The method of claim 18, wherein disengaging the antenna cover from the electronic component further comprises pivoting the antenna cover relative to the electronic component to an open position hanging generally below the electronic component when the electronic component is in the substantially vertical position.

20. The method of claim 16, wherein the remote unit assembly comprises at least one retention mechanism associated with the support plate and configured to selectively engage the electronic component, the at least one retention mechanism includes a user-accessible actuation element accessible at or along a lower surface of the support plate, and the method further comprises operating the user-accessible actuation element to allow the pivot arm and the electronic component to pivot from the substantially horizontal position to the substantially vertical position.

* * * * *